US011649648B2

(12) United States Patent
Anderson et al.

(10) Patent No.: US 11,649,648 B2
(45) Date of Patent: May 16, 2023

(54) ENHANCED SAFETY CAGE APPARATUS FOR WORK AREAS ON TOP OF ROLLING STOCK SUCH AS RAIL TANK CARS

(71) Applicant: SAM CARBIS ASSET MANAGEMENT, LLC, Florence, SC (US)

(72) Inventors: Eric Anderson, Florence, SC (US); Ronald W. Bennett, Florence, SC (US); James Quinn Sawinski, Jr., Eatonton, GA (US)

(73) Assignee: Sam Carbis Asset Management, LLC, Florence, SC (US)

( * ) Notice: Subject to any disclaimer, the term of this patent is extended or adjusted under 35 U.S.C. 154(b) by 335 days.

(21) Appl. No.: 16/909,367

(22) Filed: Jun. 23, 2020

(65) Prior Publication Data

US 2021/0025181 A1 Jan. 28, 2021

Related U.S. Application Data

(62) Division of application No. 15/966,853, filed on Apr. 30, 2018, now Pat. No. 10,724,256.

(Continued)

(51) Int. Cl.
*E04G 1/24* (2006.01)
*E04G 5/14* (2006.01)

(Continued)

(52) U.S. Cl.
CPC ..... *E04G 5/001* (2013.01); *E04G 1/24* (2013.01); *E04G 1/362* (2013.01); *E04G 3/28* (2013.01); *E04G 5/14* (2013.01); *E06C 1/39* (2013.01); *E06C 1/397* (2013.01); *E06C 7/18* (2013.01); *E04G 1/04* (2013.01); *E04G 5/10* (2013.01); *E04G 2001/242* (2013.01); *E04G 2003/283* (2013.01)

(58) Field of Classification Search
CPC .. E04G 5/001; E04G 5/14; E04G 5/10; E04G 1/24; E04G 1/362; E04G 1/04; E04G 3/28; E04G 3/305; E04G 2001/242; E04G 2003/283; E04C 1/39; E04C 1/397; E04C 7/18
See application file for complete search history.

(56) References Cited

U.S. PATENT DOCUMENTS 4,013,140 A * 3/1977 Pradon ..... B67D 7/32 182/1
4,572,328 A * 2/1986 Benko ..... B66F 11/04 182/1

(Continued)

*Primary Examiner* — Brian D Mattei
*Assistant Examiner* — Kathleen M. McFarland
(74) *Attorney, Agent, or Firm* — Dority & Manning, P.A.

(57) ABSTRACT

A cage for surrounding a section of a work area of the top of rolling stock includes an inboard side, an outboard side, a front end section and a back end section. The inboard side of the cage is attached to an associated deployment apparatus. Each of the two sides can define a pair of fence notches to slide over the rails surrounding the work area. Each of the two end sections can define an inboard notch and a center notch. Some embodiments of the end sections can define an outboard notch that includes a self-adjusting straddle. The cage can be provided as part of a portable fall protection device that includes a telescoping positioning mechanism.

10 Claims, 15 Drawing Sheets

Related U.S. Application Data

(60) Provisional application No. 62/608,098, filed on Dec. 20, 2017, provisional application No. 62/501,436, filed on May 4, 2017.

(51) Int. Cl.

| | |
|---|---|
| ***E06C 1/39*** | (2006.01) |
| ***E06C 1/397*** | (2006.01) |
| ***E06C 7/18*** | (2006.01) |
| ***E04G 5/00*** | (2006.01) |
| ***E04G 1/36*** | (2006.01) |
| ***E04G 3/28*** | (2006.01) |
| *E04G 1/04* | (2006.01) |
| *E04G 5/10* | (2006.01) |

(56) References Cited

U.S. PATENT DOCUMENTS 4,679,657 A * 7/1987 Bennett ..... B65G 69/22 182/1
5,042,612 A * 8/1991 Bennett ..... B65G 69/22 182/1
5,392,878 A * 2/1995 Bennett ..... B65G 69/22 182/1
6,405,831 B1 * 6/2002 Daniel, III ..... B66F 11/044 182/115
6,772,860 B1 * 8/2004 Nelson ..... E04G 1/24 182/115
7,140,467 B2 * 11/2006 Cook ..... B60R 3/005 182/141
7,216,741 B2 * 5/2007 MacDonald ..... B66F 11/04 182/113
8,015,647 B2 * 9/2011 Bennett ..... B65G 69/22 14/71.1
8,051,951 B2 * 11/2011 Bennett ..... B61K 13/00 182/132
8,403,109 B2 * 3/2013 Bennett ..... E06C 5/02 182/113
8,479,882 B2 * 7/2013 DuBose ..... B60P 1/00 182/113
8,479,884 B2 * 7/2013 Mizell ..... E04G 3/00 182/141
8,745,799 B1 * 6/2014 Thomasson ..... B65G 69/22 14/71.3
8,746,403 B1 * 6/2014 Tyner ..... E06C 7/16 182/127
9,133,014 B2 * 9/2015 Kenan ..... B67D 7/40
9,169,693 B2 * 10/2015 Honeycutt ..... E06C 1/397
9,409,755 B2 * 8/2016 Melton ..... B66F 11/04
9,441,382 B2 * 9/2016 Hokanson ..... E06C 7/182
10,267,122 B2 * 4/2019 Toma ..... E21B 7/026
10,465,398 B2 * 11/2019 Herzog ..... E04G 3/28
10,533,329 B2 * 1/2020 Hayman ..... E04G 7/22
10,648,235 B2 * 5/2020 Cook ..... E04G 5/10
10,655,346 B2 * 5/2020 White ..... E04G 17/14
11,203,872 B2 * 12/2021 Hilgendorf ..... E04F 11/062
11,254,527 B2 * 2/2022 Lawson ..... B65G 69/24
2003/0178253 A1 * 9/2003 Tatge ..... E04G 5/061 182/132
2011/0078864 A1 * 4/2011 Bennett ..... B65G 69/22 14/71.3
2012/0006618 A1 * 1/2012 DuBose ..... B60P 3/226 182/112
2012/0006619 A1 * 1/2012 DuBose ..... E04G 5/14 182/113
2013/0256058 A1 * 10/2013 Borghi ..... B66F 11/04 182/113
2014/0041963 A1 * 2/2014 O'Shea ..... E06C 7/16 182/64.1
2014/0367195 A1 * 12/2014 Melton ..... E06C 1/39 182/115
2019/0017281 A1 * 1/2019 Luna ..... E04G 5/10
2020/0270107 A1 * 8/2020 Hokanson ..... E04G 1/18
2021/0095482 A1 * 4/2021 Fleming ..... B64F 5/40
2021/0261273 A1 * 8/2021 Johnston ..... E04G 3/28

* cited by examiner

ENHANCED SAFETY CAGE APPARATUS FOR WORK AREAS ON TOP OF ROLLING STOCK SUCH AS RAIL TANK CARS

CROSS-REFERENCE TO RELATED APPLICATIONS

The present application is a divisional of U.S. application Ser. No. 15/966,853 filed on Apr. 30, 2018, which claims filing date priority benefit to U.S. application Ser. No. 62/501,436 filed on May 4, 2017, and to U.S. application Ser. No. 62/608,098 filed on Dec. 20, 2017, all of which is incorporated herein by reference for all purposes.

STATEMENT REGARDING FEDERALLY SPONSORED RESEARCH OR DEVELOPMENT

Not applicable.

FIELD OF THE INVENTION

The subject matter disclosed herein generally involves fall protection equipment for accessing the tops of rolling stock, and particularly so-called worker safety cages that can be lowered down onto the tops of rolling stock.

BACKGROUND OF THE INVENTION

It is necessary to provide workers with access to various work areas at the tops of rolling stock such as tank cars, which are used to transport flowing materials that typically are in liquid form but occasionally in granular form. As these tank cars are cylindrical in shape, the tops of these tank cars are curved, making for curved surfaces on which workers must maintain their balance when accessing various work areas. Though some work areas are provided with level platforms, because flowing materials are involved, even work areas with such level platforms often include slippery surfaces on which the workers must tread when carrying out their assigned duties. Various weather conditions such as rain, sleet, snow and ice also can provide and/or exacerbate slippery surfaces that can cause workers to slip and fall when carrying out their assigned duties. Thus, these work areas typically are furnished with some sort of railing structure that runs the length and width of the work area at the top of the rolling stock. However, these railing structures typically are inadequate to prevent workers from falling to the ground after slipping through one of the openings in the railing structures or tumbling over the top of the railing structures.

Before workers are permitted to access the tops of rolling stock (tank trucks, tank railroad cars, etc.), a cage can be deployed surrounding the portion of the top of the rolling stock where the workers are to be engaged in their duties. Examples of these sorts of safety cages can be found in U.S. Pat. Nos. 7,216,741; 8,479,884; 8,403,109; 8,479,882; 6,405,831; 4,679,657; 9,409,755; which are hereby incorporated herein by this reference for all purposes.

Each cage typically assumes the shape of a rectangular box having contiguous pairs of the sides connected to each other in what is essentially a right angle. In some embodiments, the corners of each cage can be curved rather than a sharp right angle. Conventionally, the cage's side that is disposed closest to the structure from which the cage is deployed will be considered the inboard side of the cage. Similarly, the cage's side that is disposed farthest away from the structure from which the cage is deployed will be considered the outboard side. One of the opposite ends of the front of the cage is connected to the inboard side while the other opposite end of the front of the cage is connected to the outboard side of the cage. Similarly, one of the opposite ends of the back of the cage is connected to the inboard side while the other opposite end of the back of the cage is connected to the outboard side of the cage.

However, as depicted in U.S. Pat. Nos. 9,133,014 and 8,051,951, which are hereby incorporated herein by this reference for all purposes, because of the presence of the railing structure, such cages remain above the top handrails and fail to provide any fall protection deployed beneath the top handrails of the railing structure. As a result, the openings beneath the top handrail can range between 22 and 30 inches and thus remain big enough for a person to slip through, thereby failing to provide adequate worker fall protection. Moreover, these cages resting on the top handrails of the railing structure typically are small (on the order of a foot tall above the handrail). Some cage structures are more elaborate and require expensive subsystems that must be activated before it is deemed safe for workers to access the work areas on the tops of the rolling railing stock. However, improper activation of these subsystems renders them less effective, and thus these subsystems require the presence of workers who are trained to operate such subsystems.

Because the railing structures atop the tanks come in a variety of different configurations, it is difficult to match the cage configuration with the railing structure in a way that ensures fall protection for the workers engaged in their duties at the particular section of the top of the rolling stock where these worker duties are to be carried out. Having to stockpile different cages with different configurations in anticipation of satisfying the requirements of many different configurations for the railing structures is so problematical as to be economically not feasible. Moreover, the worker's duties involve tasks that sometimes must be performed when the rolling stock is parked in different sorts of environments that affect the best way for these cages to be deployed to address the particular location atop the loading stock where such worker tasks are to be performed. Even so, having personnel on hand who are sufficiently competent to manipulate the cages appropriately with respect to the environments where the loading stock is parked and with respect to the configuration of the various railing structures also poses problems. Less competent personnel take longer to deploy the cages, and securing personnel sufficiently competent to deploy the cages can delay the performance of the tasks and tie up loading sites while the requisite personnel are secured. Such delays add additional cost to the performance of these tasks.

Accordingly, a need exists for apparatus that addresses these issues raised above in a manner that is uncomplicated, reliable and minimizes the need for special worker training.

BRIEF DESCRIPTION OF THE DRAWINGS

Aspects and advantages of the invention are set forth below in the following description, or may be obvious from the description, or may be learned through practice of embodiments of the invention. Those of ordinary skill in the art will better appreciate the features and aspects of such embodiments, and others, upon review of the specification. A full and enabling disclosure of the present invention, including the best mode thereof to one skilled in the art, is set forth more particularly in this specification, including reference to the accompanying figures, in which.

Figure 1:
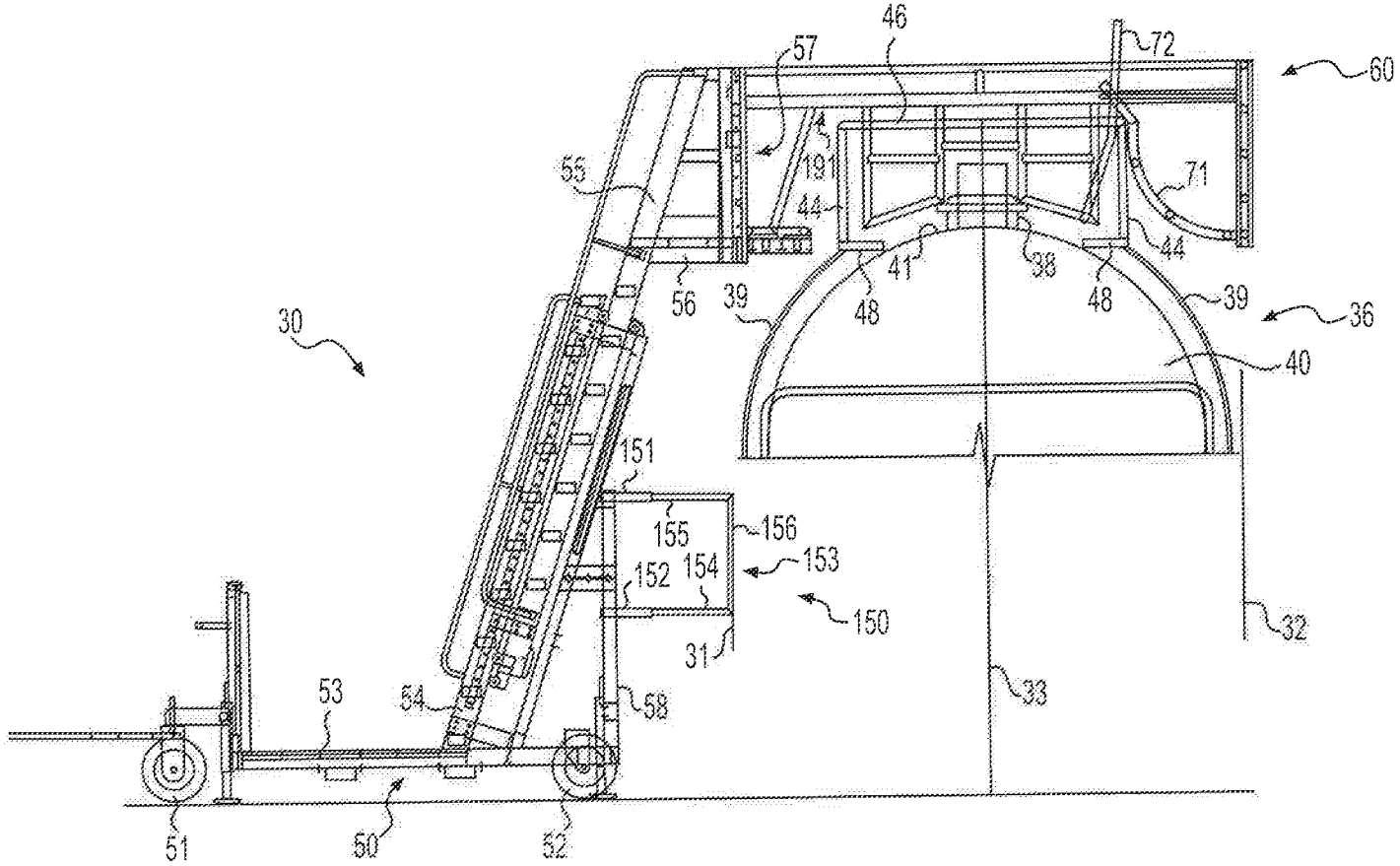
FIG. 1 is an end view of an embodiment of the present invention with the fall protection cage disposed in an orientation lowered around the top of a tank of a railcar for which the Standard Plate C Envelope is schematically represented and being shown in relation to the edge of an adjustable positioning mechanism that ensures that the portable deployment apparatus is spaced from the railcar by a distance that ensures precisely lowering of the cage with respect to the fence at the top of the tank.

The accompanying drawings, which are incorporated in and constitute a part of this specification, illustrate at least one presently preferred embodiment of the invention as well as some alternative embodiments. These drawings, together with the written description, serve to explain the principles of the invention but by no means are intended to be exhaustive of all of the possible manifestations of the invention.

DETAILED DESCRIPTION OF EXEMPLARY EMBODIMENTS OF THE INVENTION

Reference will now be made in detail to present exemplary embodiments of the invention, wherein one or more examples of which are illustrated in the accompanying drawings. The detailed description uses numerical and letter designations to refer to features in the drawings. Like or similar designations in the drawings and description have been used to refer to like or similar parts of the embodiments of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

It is to be understood that the ranges and limits mentioned herein include all sub-ranges located within the prescribed limits, inclusive of the limits themselves unless otherwise stated. For instance, a range from 100 to 200 also includes all possible sub-ranges, examples of which are from 100 to 150, 170 to 190, 153 to 162, 145.3 to 149.6, and 187 to 200. Further, a limit of up to 7 also includes a limit of up to 5, up to 3, and up to 4.5, as well as all sub-ranges within the limit, such as from about 0 to 5, which includes 0 and includes 5 and from 5.2 to 7, which includes 5.2 and includes 7. Moreover, while specific spatial dimensions are provided for some of the exemplary embodiments described herein, the present invention is not limited to embodiments with those specific spatial dimensions.

The standard dimensional envelope occupied by a railway tank car, commonly referred to as the Standard Plate C Envelope, applies to the majority of the rolling rail stock throughout North America and is schematically represented in FIG. 1 in an outline formed of two parallel vertical lines 31, 32. The vertically extending line 31 in FIG. 1 schematically represents the inboard side of the Standard Plate C Envelope in relation to the chassis of a portable loading apparatus 30. The vertically extending chain-dashed line 32 in FIG. 1 schematically represents the outboard side of the Standard Plate C Envelope in relation to the portable loading apparatus 30. The vertically extending line 33 in FIG. 1 schematically represents the vertical centerline of the Standard Plate C Envelope and often provides a convenient frame of reference for measuring the distance from the nearest edge of the portable loading apparatus 30.

Figure 2:
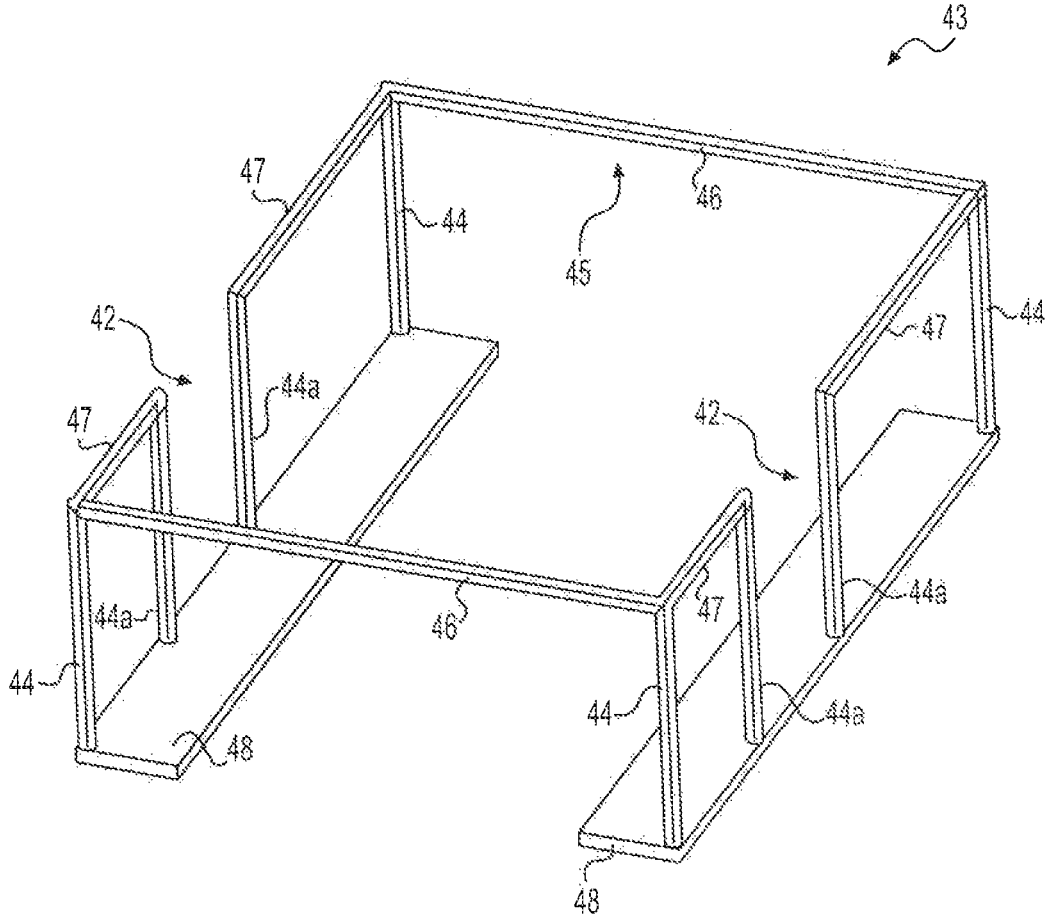
FIG. 2 is a schematic representation of a perspective view of an embodiment of a fence that typically might be encountered at the top of the tank of a railcar.

FIG. 1 also schematically presents the respective inboard side 31, centerline 33 and outboard side 32 of the Standard Plate C Envelope in relation to a tank car 36 sitting stationary on a side track. However, for the sake of simplicity, only the upper portion of the tank car 36 is schematically represented in FIG. 1, the lower half being omitted. The main body of the tank car 36 is a tank 40 that typically has a cylindrical shape, and accordingly the top 41 of the tank 40 has a curved shape. Because workers easily lose balance when trying to find footing on such a curved shape and moreover because of the likelihood of encountering slippery surfaces thereon, provision must be made for protection of workers who might slip and fall from the top 41 of the tank 40. Thus, often the top 41 of the tank 40 on railcars or trucks is outfitted with a fence around the work area of the top 41 of the tank 40. FIG. 2 schematically presents a perspective view of a simple version of this fence 43, which typically includes posts 44 vertically extending above the top 41 of the tank 40. The fence 43 typically is provided with a handrail 45 that is supported at the upper ends of the posts 44 and thus disposed above and surrounding the work area at the top 41 of the tank 40. The handrail 45 of the fence 43 typically is composed of end rails 46 that are connected to the tops of the posts 44 and extend laterally across the width of the tank 40 shown in FIG. 1. Similarly, as schematically shown in FIG. 2, the fence 43 includes side rails 47 that extend lengthwise across the top 41 of the tank 40 shown in FIG. 1. Typically, a ladder is provided on the opposite sides of the tank 40, and the ladder includes side rails 39 that conform at least partially to the curvature of the exterior sides of the tank 40 and extend outwardly from the top 41 of the tank 40 as schematically shown in FIG. 1 for example. At the top of the ladder, as schematically shown in FIG. 2, there will be an entrance opening 42 through which workers can access the top 41 of the tank 40. The entrance opening 42 in the fence 43 is defined by a pair of longitudinally spaced apart and vertically extending entrance posts 44*a*, and the access opening 42 is defined in part by an interruption in the respective side rail 47. However, depending upon the configuration of the tank 40 for example, the location of the ladder and the location of this entrance opening 42 can be varied. As schematically shown in dashed line in FIG. 1, the fence typically will surround a hatch 38 that controls access to the interior of the tank 40 and has a sidewall that extends vertically above the top 41 of the tank 40.

As schematically shown in FIG. 2, a footing plate 48 desirably runs down the length of each side of the fence 43, and the base of each post 44, 44*a* extends vertically above one of the respective footing plates 48. As schematically shown in FIG. 1, each footing plate 48 rests against the top 41 of the tank 40. As is apparent from the view shown in FIG. 2, the fence 43 leaves considerable open areas between the handrail 45 and the footing plate 48. The same large open areas exist between the handrail 45 and the top 41 of the tank 40 schematically shown in FIG. 1. These open areas are problematical because a worker losing balance on the top 41 of the tank 40 can slide through these open areas and fall to the ground and accordingly sustain injury.

Thus, even when the top 41 of the tank 40 is provided with a fence 43, additional railcar access fall protection is desired. Providing such additional railcar access fall protection can involve the deployment of a cage that must surround a particular region of the top 41 of the rolling stock. However, in deploying this additional cage, the pre-existing fence 43 must be accommodated in a way that does not compromise the desired fall protection for the workers engaged around the top 41 of the tank 40 in performing the tasks entailed by their duties. It is these sorts of cages and associated deployment apparatus that are the subject of the various embodiments of the present invention described more fully below. Examples of some embodiments of these cages and associated deployment apparatus that are intended for addressing environments remote from fixed loading stations are portable and are shown in various perspective views in FIGS. 1, 3, 4 and 5. While an example of other embodiments of these cages and associated deployment apparatus that are intended for fixed loading stations is shown in a perspective view in FIG. 6 for example.

In the exemplary embodiments described herein, each cage defines a generally quadrilateral shape. For the sake of convenience, the embodiments of the cages of the present invention will be described with reference to the following conventions. The length of the work area with respect to which the cage is to be positioned during its intended use providing fall protection for workers performing duties on the top 41 of the rolling stock, whether the particular rolling stock should be a tank rail car or a tank truck, will define the longitudinal direction, which is typically parallel to the direction of transport of the railcar. The length of the work area is measured in the direction of the length of the rail car. The width of the work area defines the transverse direction, which is perpendicular to the longitudinal direction, and the width of the work area is measured in the direction of the width of the rail car and is the direction in which the Standard Plate C Envelope is shown in FIG. 1. The vertical direction is perpendicular to each of the longitudinal direction and the transverse direction and is the direction along which the gravitational force acts on the rolling stock and on the cage and associated deployment apparatus for the cage. The side of each cage through which the workers gain entrance into the cage when the cage is positioned to perform its intended function to provide fall protection for workers performing duties on top 41 of the rolling stock will be considered the inboard side of the cage and is one of the two sides of the cage that extends in the longitudinal direction, which is a direction that is parallel to the length of the rolling stock according to the convention adopted herein. The other side of the cage that extends in the longitudinal direction is termed the outboard side of the cage, which is disposed spaced apart in the transverse direction from the inboard side of the cage. Each of the respective opposite ends of the inboard side and outboard side of the cage is connected to each other by the span of a respective front section or back section of the cage. Thus, a first end of the outboard side of the cage is connected to a first end of the inboard side of the cage by a front section of the cage that extends in the transverse direction to span between these two opposing first ends of the respective inboard side and outboard side of the cage. Similarly, the opposite end of the outboard side of the cage is the second end that is connected to the second end of the inboard side of the cage by a back section of the cage that also extends in the transverse direction. The back section of the cage is disposed opposite the front section of the cage and spaced apart in the longitudinal direction from the front section of the cage by a distance according to the length of the respective inboard side of the cage and the length of the respective outboard side of the cage. Moreover, in a presently preferred embodiment, the configuration of each of the front and back sections of the cage typically is identical so as to simplify the inventory necessary to manufacture this presently preferred embodiment of the cage. However, each front section and back section can be differently configured to accommodate a customized railing configuration on the top of a railcar. The depth of the cage is measured in a direction that is perpendicular to each of the longitudinal and transverse directions and is the direction that is vertically disposed with respect to the work area when the cage is in operation and positioned around the work area.

In accordance with one aspect of the present invention, embodiments of a railcar access fall protection cage and associated deployment apparatus that are portable for addressing environments remote from fixed loading stations are shown in FIGS. 1 and 3-5. In the embodiment depicted in FIGS. 1, 3 and 4, the cage is generally designated by the numeral 60. In the embodiment depicted in perspective view in FIG. 5, an alternative embodiment of the cage is generally designated by the numeral 160. A stationary platform carrying the alternative embodiment of the cage 160 is shown in a perspective view in FIG. 6.

Examples of suitable portable deployment apparatus 30 associated with embodiments of the cage 60, 160 and including a platform, extension ladder, stationary ladder, base and chassis can be found for example in commonly owned U.S. Pat. No. 9,133,014, which is hereby incorporated herein by this reference for all purposes. Briefly, the cage 60 in FIG. 1 is connected to and carried by a portable deployment apparatus 30 that desirably includes a chassis 50 that is rendered mobile by a plurality of rotatable wheels 51, 52 connected to the chassis 50. A base 53 is connected to and carried by the chassis 50. A stationary ladder 54 is suitably braced and supported above the base 53 and has a lower end anchored to the base 53. An extension ladder 55 is selectively extensible and retractable from the stationary ladder 54. A platform 56 is connected to the upper end of the extension ladder 55. The direction in which the extension ladder 55 is extendable from the stationary ladder 54 has a component in the vertical direction as well as a component in the transverse direction relative to the base 53. The platform 56 leads to an access opening 57 through which the worker can gain access from the extension ladder 55 to the top 41 of the tank 40.

Figure 3:
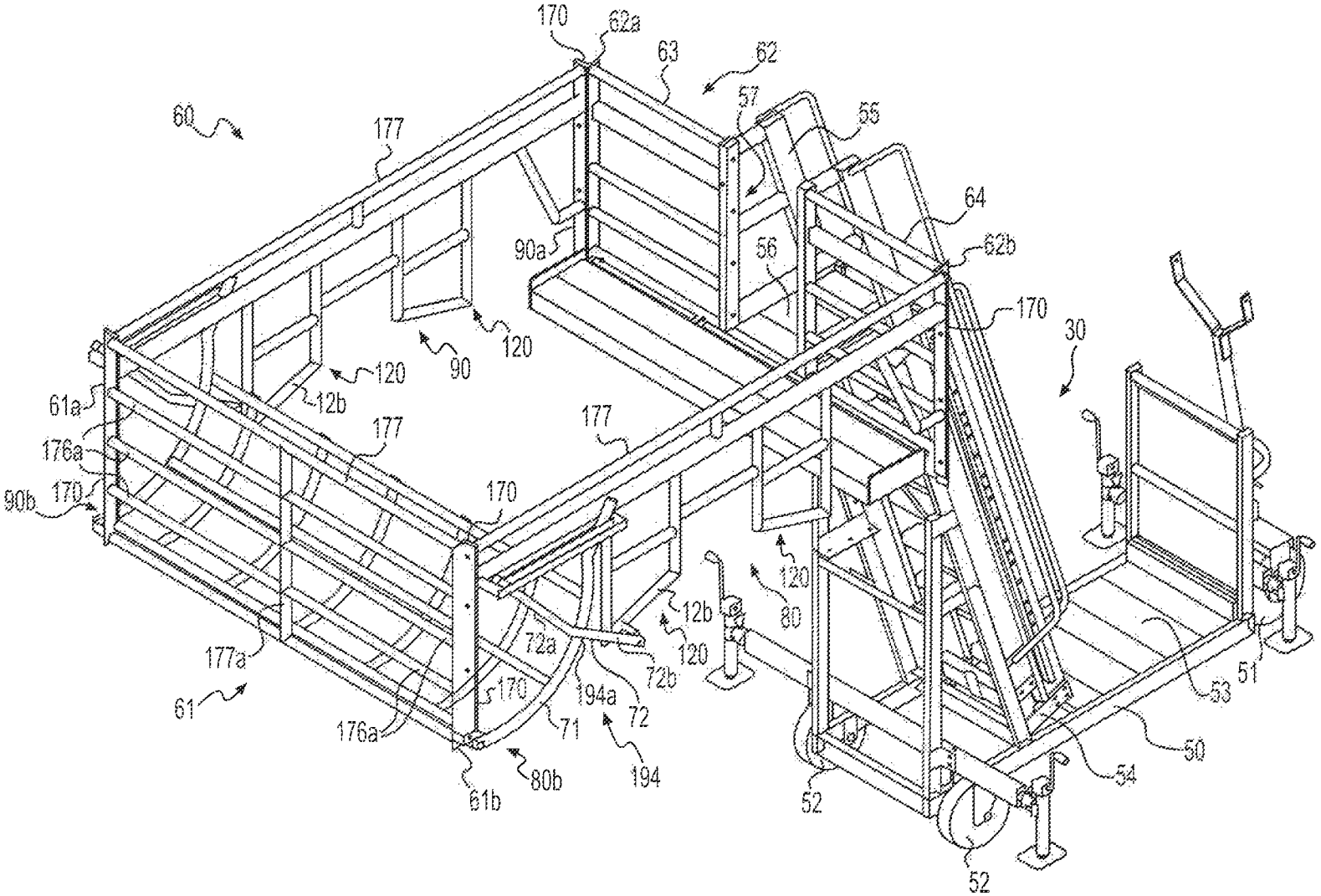
FIG. 3 is a perspective view of the embodiment of the present invention depicted in FIG. 1 but with the adjustable positioning mechanism omitted for the sake of simplicity.
Figure 4:
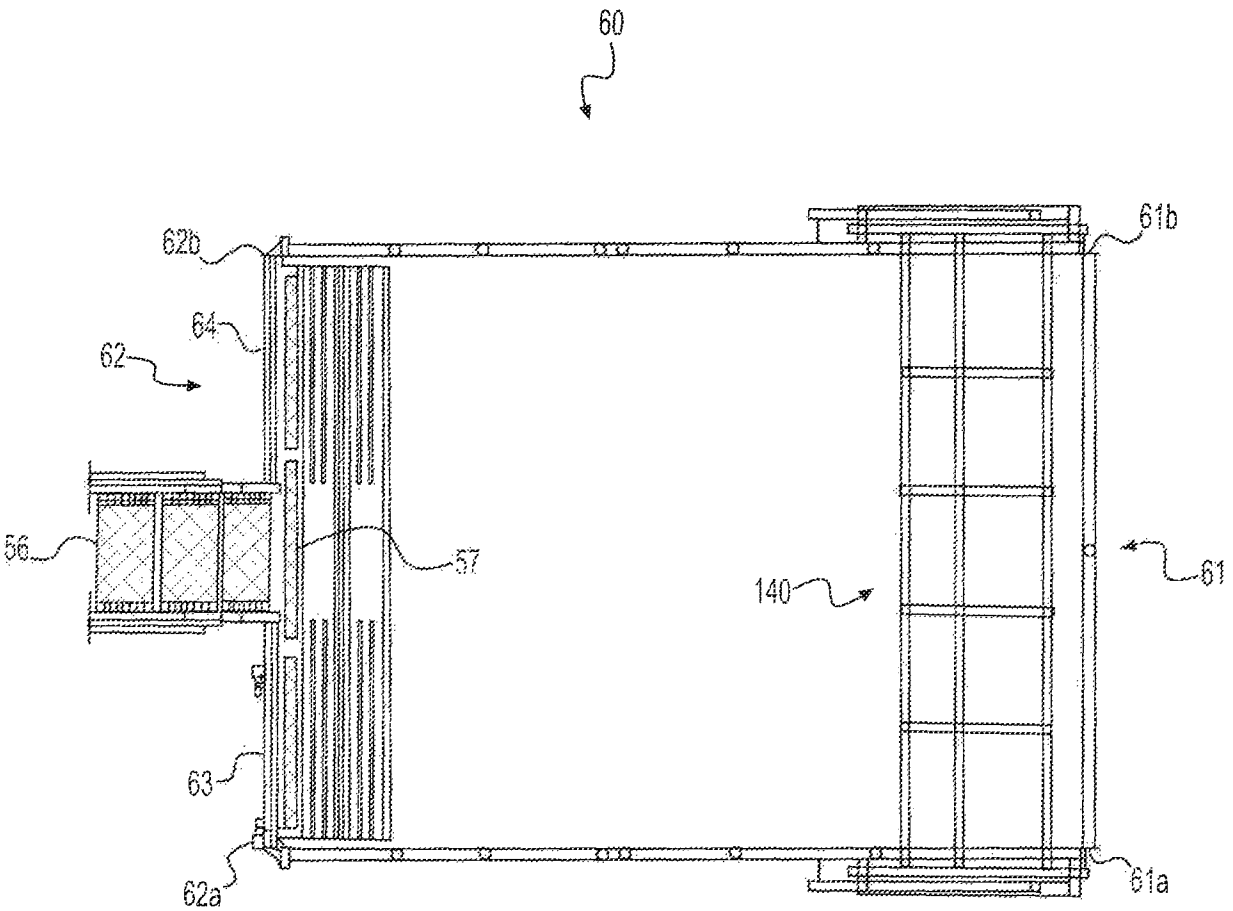
FIG. 4 is a view of the cage of the embodiment of the present invention depicted in FIGS. 1 and 3 taken from above.
Figure 5:
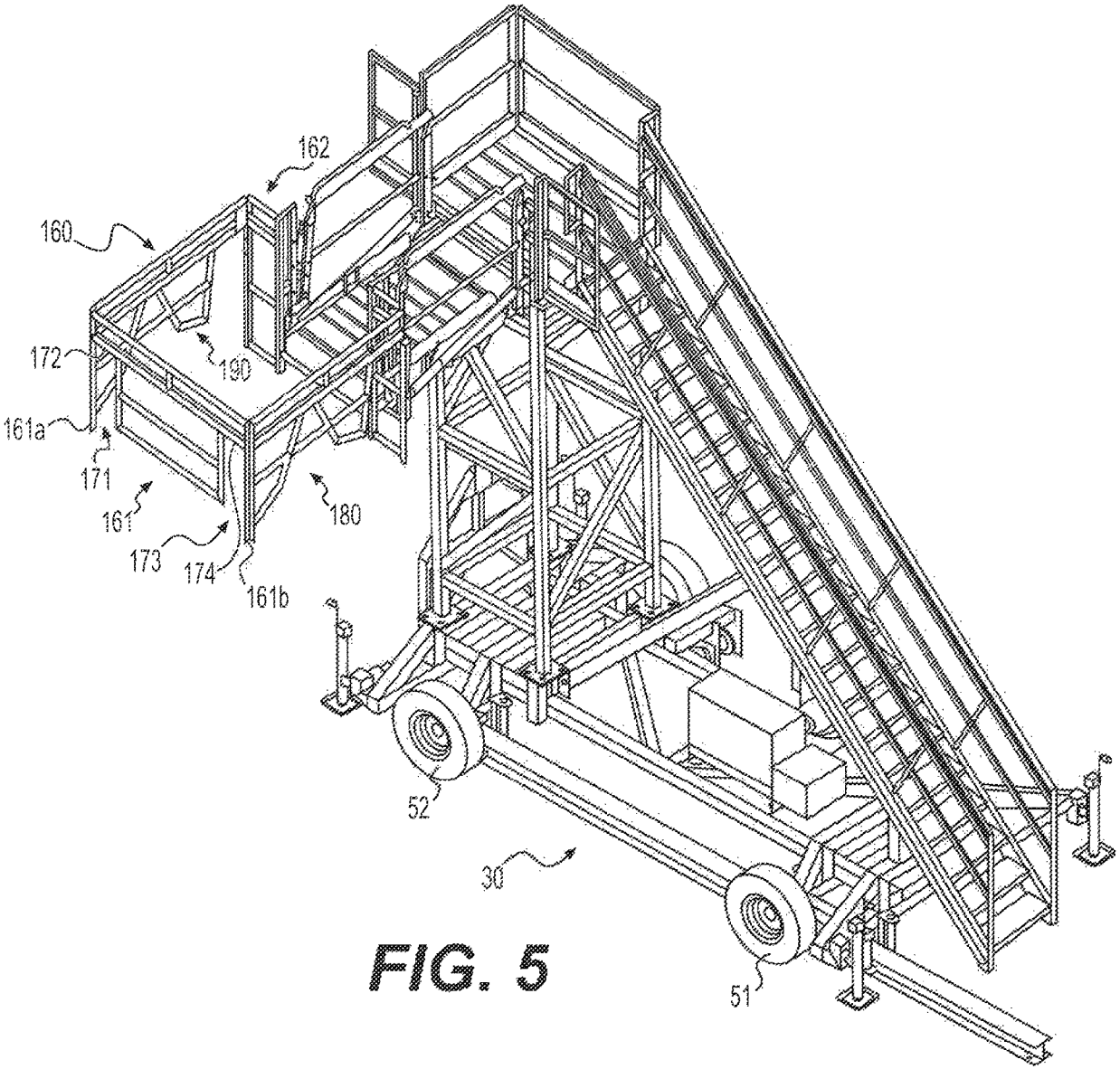
FIG. 5 is a perspective view of an alternative embodiment of a portable platform carrying an alternative embodiment of a cage in accordance with the present invention.

Turning now to the cages 60, 160 themselves, as schematically shown in FIGS. 3, 4 and 5 for example, each embodiment desirably is formed by a lattice structure defining a generally quadrilateral shape. The lattice structure is defined by a top edge and a bottom edge, and the lattice structure has a depth that extends in a direction between the top and bottom edges. The lattice structure has a length measured in a longitudinal direction and a width measured in a transverse direction that is perpendicular to the longitudinal direction and perpendicular to the direction in which the depth extends. The lattice structure desirably is formed by a plurality of interconnected tubular members, which leaves a plurality of open areas between the tubular members but aims to constrain the size of each of the open areas to prevent passage of the body of a worker through the open area. In this way, the lattice structure functions as would a netting that prevents passage of bodies greater than a certain size and so compensates for the considerable open areas that exist between the handrail 45 and the footing plate 48 shown in FIG. 2 for example. The interconnected tubular members of the lattice structure typically are hollow and have circular transverse cross-sectional shapes. However, tubular members with other transverse cross-sectional shapes, such as squares or rectangles, can be used. Moreover, each corner of the lattice structure desirably is anchored by a right-angle flange. In consideration of the trade-off between strength and weight, the lattice structure desirably is composed of structural aluminum.

As schematically shown in FIG. 3 for example, the lattice structure of the fall protection cage 60 includes an outboard side that is designated generally by the numeral 61 and elongates along the length of the cage 60 between a front end 61*a* of the outboard side 61 and a back end 61*b* of the outboard side 61. As schematically shown in FIG. 5 for example, the lattice structure of the fall protection cage 160 includes an outboard side that is designated generally by the numeral 161 and elongates along the length of the cage 160 between a front end 161*a* of the outboard side 161 and a back end 161*b* of the outboard side 161.

Figure 7:
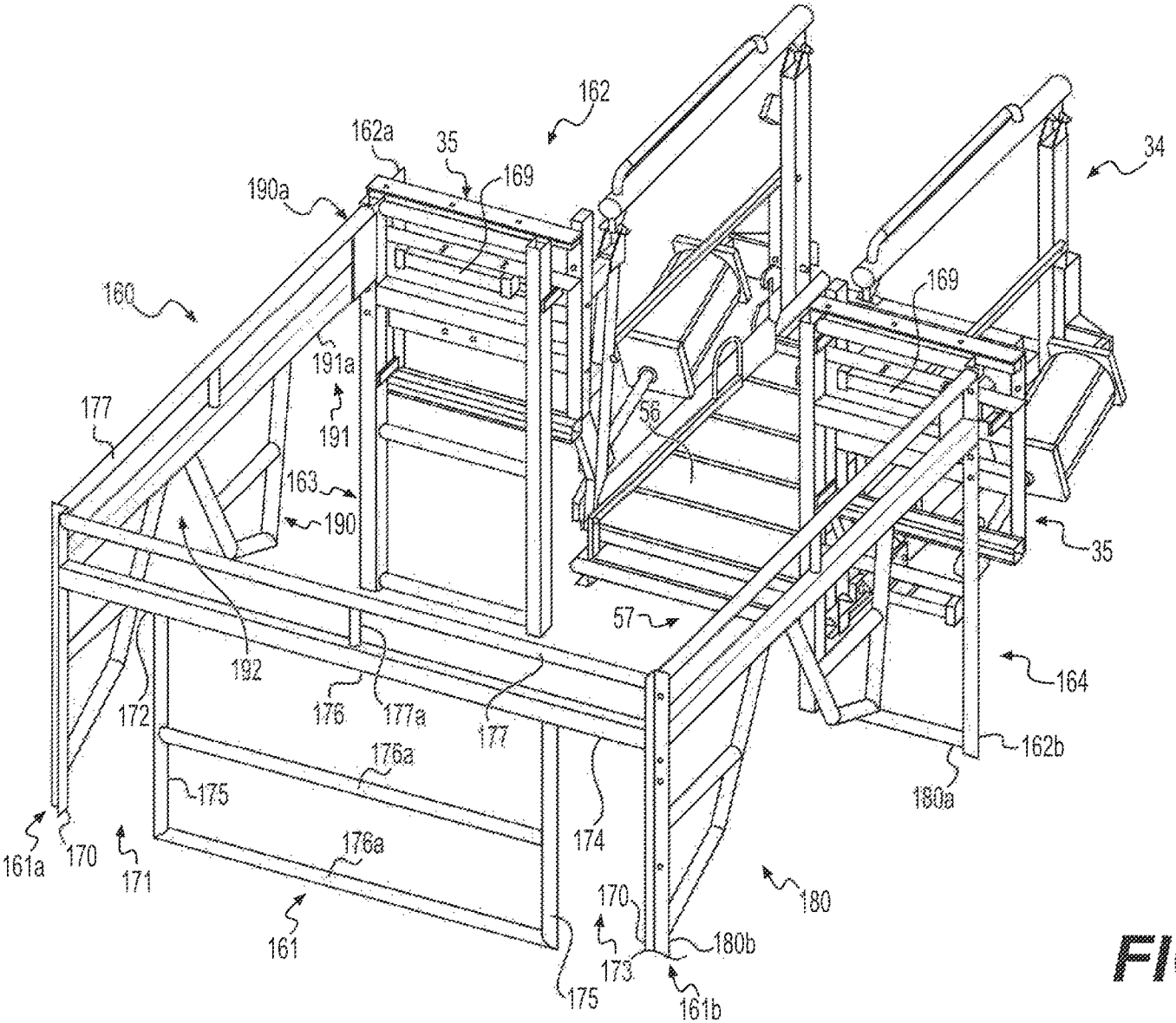
FIG. 7 is an elevated perspective view of a cage illustrating aspects of an embodiment of the present invention.

As schematically shown in FIGS. 5 and 7 for example, the front end 161*a* of the outboard side 161 of the lattice structure forming the cage 160 defines a front fence notch 171 with a blind end 172 near the top edge of the cage 160 and an open end at the bottom edge of the cage 160. Similarly, the back end 161*b* of the outboard side 161 defines a back fence notch 173 with a blind end 174 near the top edge of the cage 160 and an open end at the bottom edge of the cage 160. The shape of each front fence notch 171 and back fence notch 173 is configured so that the outboard side 161 of the cage 160 can be fitted over the end rails 46 of the handrail 45 of the fence 43 shown in FIG. 2 for example.

As shown in FIG. 7 for example, each opposite end 161*a*, 161*b* of the outboard side 161 of the cage 160 is defined by a corner pillar 170 that desirably can be formed by a three-foot 10 inch length of angle iron formed of aluminum measuring 3"×3"×0.25". Disposed centrally between the corner pillars 170 is a center grill (described more fully below) that is defined at each of its ends by a minor vertical support 175 that desirably is aligned parallel to the adjacent corner pillar 170 and disposed spaced apart from the adjacent corner pillar 170 in the longitudinal direction by a distance intended to accommodate most of the configurations of the fence 43 that are likely to be encountered on the top 41 of these tanks 40. In the embodiments shown in FIGS. 5, 6 and 7, this distance is for example 8 inches forming a respective fence notch 171, 173 at each opposite end 161*a*, 161*b* of the outboard side 161 of the cage 160 in accordance with one aspect of the present invention. The minor vertical support 175 desirably is formed of 0.125 inch thickness aluminum tubing having a circular cross-section with a 1.5 inch outer diameter.

Figure 6:
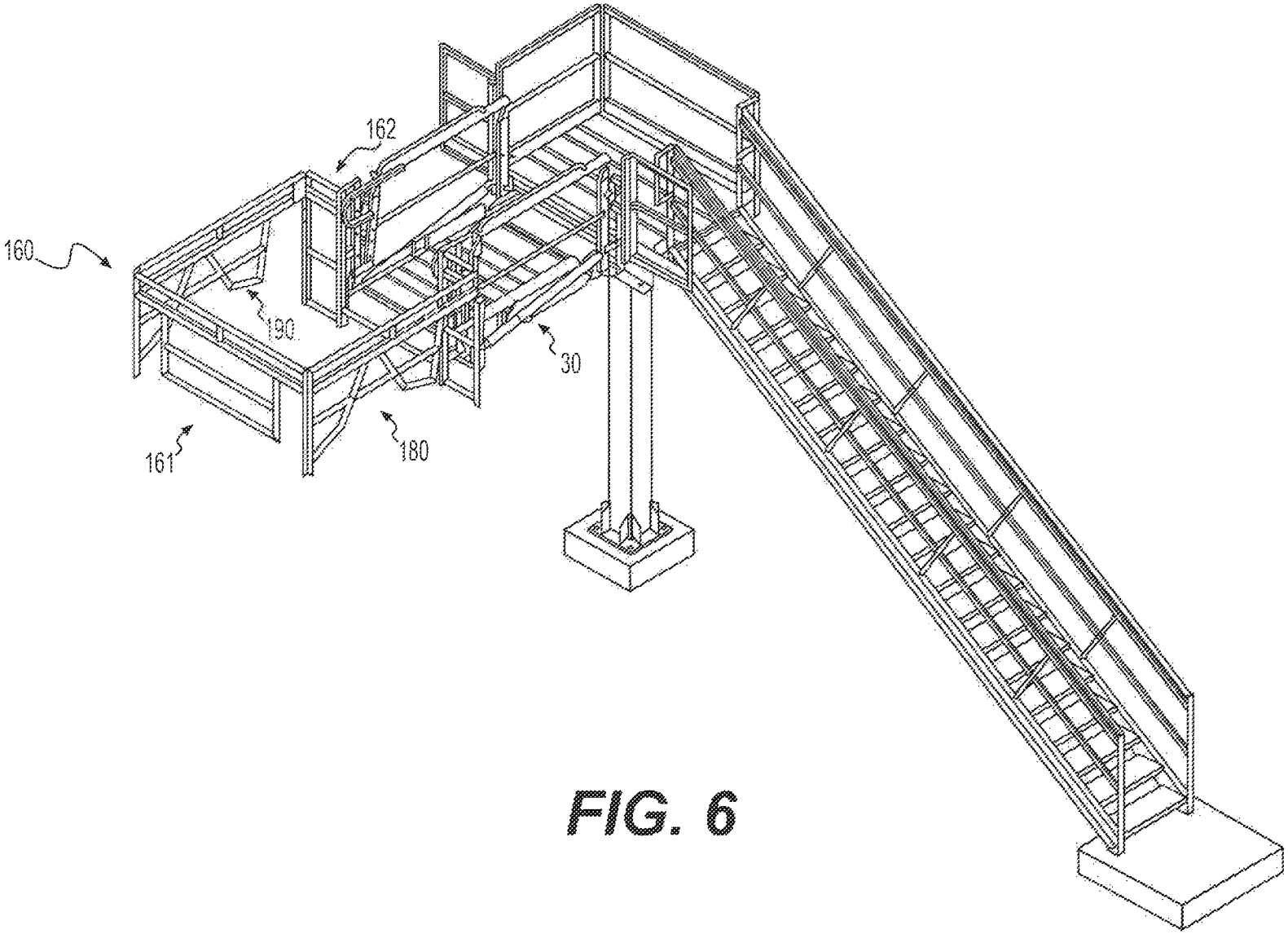
FIG. 6 is a perspective view of an alternative embodiment of a stationary platform carrying the alternative embodiment of the cage shown in FIG. 5.
Figure 14:
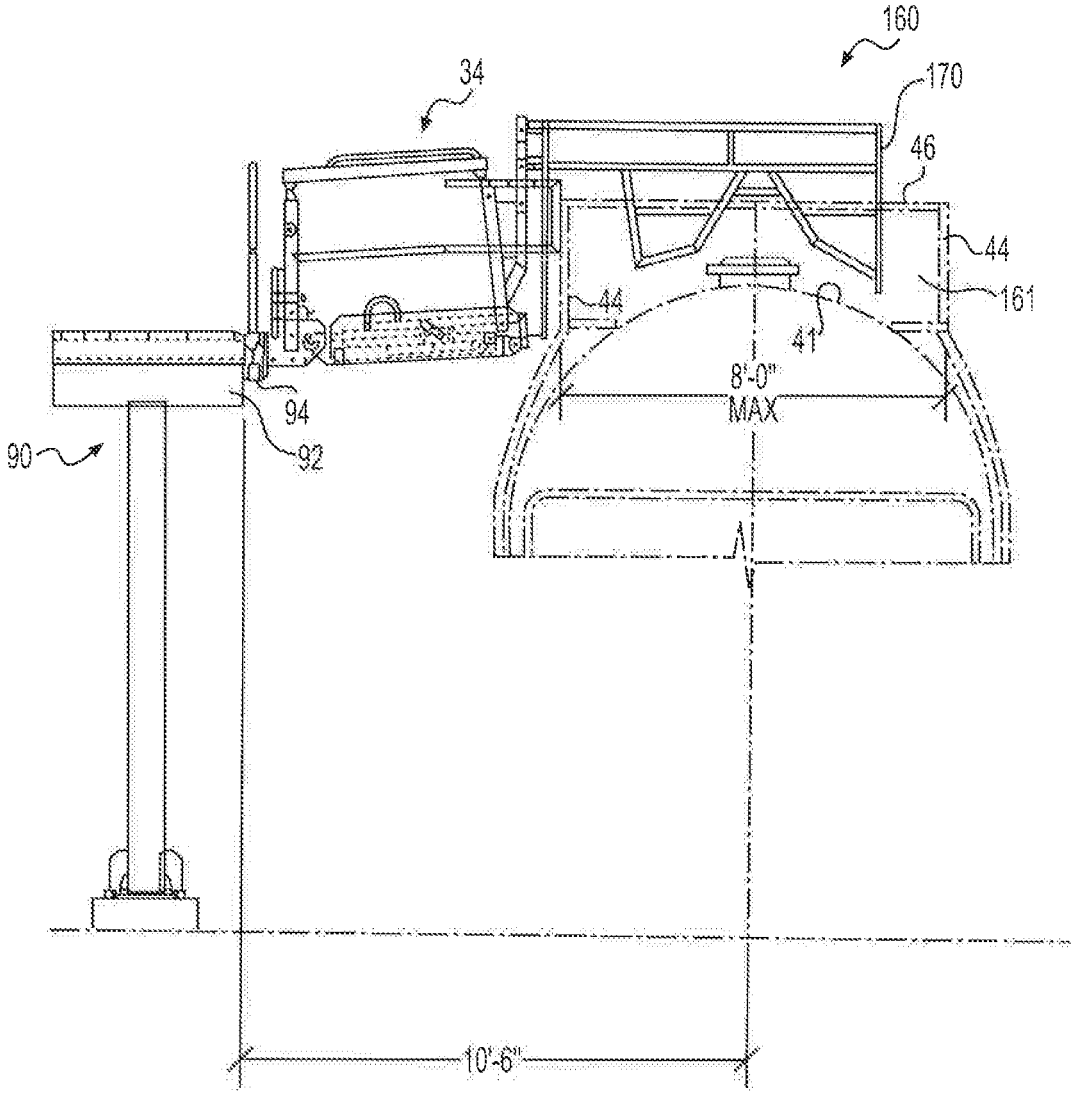
FIG. 14 is an end view an embodiment of the present invention disposed in an orientation that is being lowered toward the top of a tank shown in partial outline with the top hatch and guardrails.
Figure 15:
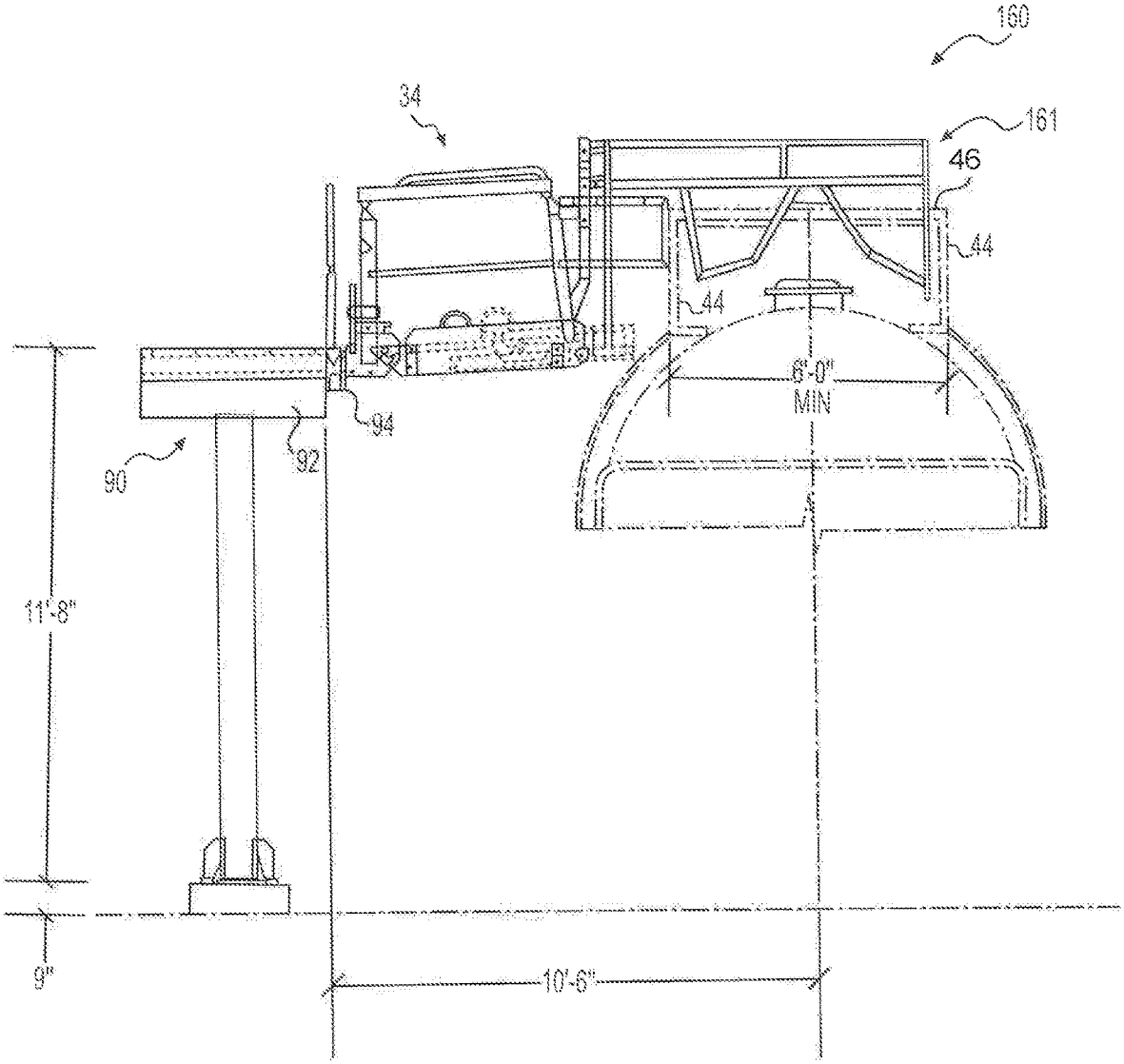
FIG. 15 is an end view another embodiment of the present invention disposed in an orientation that is being lowered toward the top of a tank shown in partial outline narrower than the tank depicted in FIG. 14.

Thus, the fence notch 171, 173 formed at each opposite end 161*a*, 161*b* of the outboard side 161 of the cage 160 has a rectangular configuration in the embodiment shown in FIGS. 5, 6 and 7 but notches of other shapes can be defined between the minor vertical support 175 and the adjacent corner pillar 170. As shown in FIGS. 14 and 15 for example, as the cage 160 is lowered, the fence notches 171, 173 between the minor vertical support 175 and the associated corner pillar 170 at each opposite end 161*a*, 161*b* of the outboard side 161 of the cage 160 will accommodate, by sliding over and receiving therein, the transversely extending railing portions 46 (See FIG. 2) of the fence 43 on the top 41 of the tank 40. The front fence notch 171 and the back fence notch 173 defined in the outboard side 161 of the cage 160 allows a certain amount of misalignment between the cage 160 and the end rails 46 of the fence 43 surrounding the work area at the top 41 of the tank 40.

As shown in FIG. 7 for example, the uppermost end of the minor vertical support 175 desirably is welded to the underside of a major horizontal support 176 of the outboard side 161 of the cage 160. The major horizontal support 176 elongates in the longitudinal direction, which would be disposed parallel to the walking surface of the footing plate 48 of fence 43 when the cage 160 is deployed in operation around the top 41 of the tank 40. Each opposite end of the major horizontal support 176 is rigidly attached to one of the legs of a respective one of the corner pillars 170. The major horizontal support 176 desirably is formed of 0.125 inch thickness aluminum tubing having a rectangular cross-section measuring 2" wide by 3" tall. As shown in FIG. 7 for example, a plurality, and desirably at least two, minor horizontal supports 176*a* are spaced apart from one another and are connected at their opposite ends to a respective one of the two minor vertical supports 175 of the outboard side 161 of the cage 160. Each of these minor horizontal supports 176*a* similarly desirably is formed of 0.125 inch thickness aluminum tubing having a circular cross-section 1.5 inch outer diameter. Thus, the center grill is formed by the minor vertical supports 175, the major horizontal support 176 and the minor horizontal supports 176*a*, each rigidly connected as by welding as noted above.

The outboard side 61 of the cage 60 shown in FIG. 3 for example does not include any notches for accommodating the fence 43. This is because this embodiment of the outboard side 61 of the cage 60 is configured so that it can fit entirely within the fence 43 or the fence 43 can fit entirely within the cage 60. Accordingly, the center grill extends completely across the entire length of the outboard side 61 of the cage without any interruption for any notches. When the cage 60 must be large enough to completely envelop the fence 43, then the length of the outboard side 61 can demand a center crutch 177*a* disposed midway between the corner pillars 170. In such an embodiment as shown in FIG. 3, each of the minor horizontal supports 176*a* will extend between the center crutch 177*a* and one of the corner pillars 170. As shown in FIG. 3 for example, the upper end of the center crutch 177*a* desirably is welded to a handrail 177 that elongates in the longitudinal direction, which would be disposed parallel to the walking surface of the footing plate 48 of fence 43 when the cage 60 is deployed in operation around the top 41 of the tank 40. Each opposite end of the handrail 177 is rigidly attached to one of the legs of a respective one of the corner pillars 170.

As shown in FIG. 7 for example, spaced vertically above the major horizontal support 176 of the cage 160 is a handrail 177 that elongates in the longitudinal direction, which would be disposed parallel to the walking surface of the footing plate 48 of fence 43 when the cage 160 is deployed in operation around the top 41 of the tank 40. So as to prevent central sagging of the handrail, a center crutch 177*a* can be disposed to extend in a vertical direction centrally between the handrail 177 and the major horizontal support 176 of the outboard side 161 of the cage 160. Each of these center crutches 177*a* and handrails 177 similarly desirably is formed of 0.125 inch thickness aluminum tubing having a circular cross-section with a 1.5 inch outer diameter. Desirably, these elements of the outboard side 161 of the cage 160 are permanently connected to one another as by welding for example.

Figure 13:
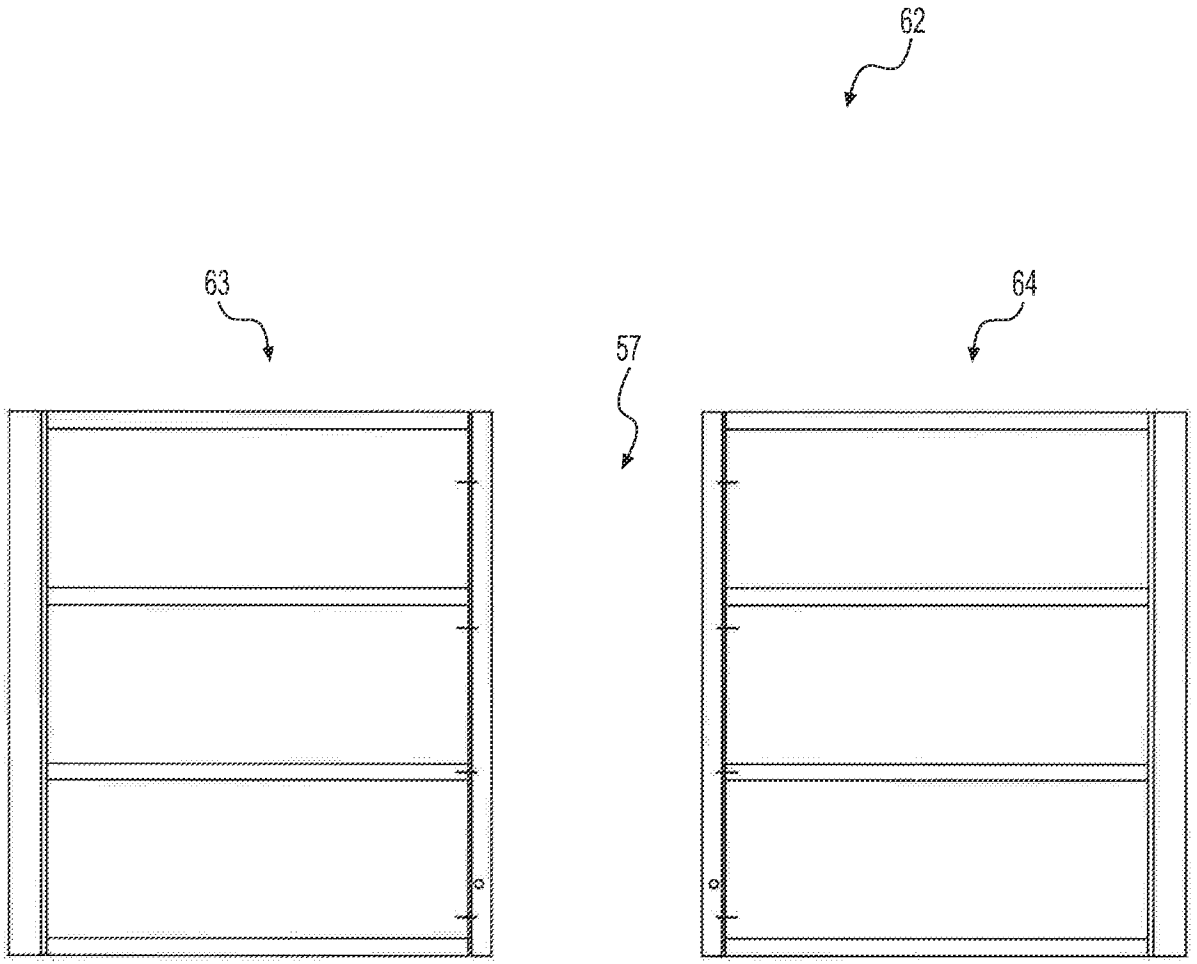
FIG. 13 is a view of the inboard side the cage separated from the two end sections of the cage.

As schematically shown in FIG. 3 for example, the lattice structure includes an inboard side 62 elongating along the length of the cage 60 between a front end 62*a* and a back end 62*b*. The inboard side 62 of the cage 60 is disposed spaced apart from the outboard side 61 of the cage 60 along the width of the cage 62. The inboard side 62 is configured for attachment to a deployment apparatus, such as the deployment apparatus 30 schematically shown in FIG. 3 for example. Thus, the inboard side 62 of the cage 60 desirably includes a front section 63 that is spaced apart from a back section 64 so that an access opening 57 is defined between the two sections 63, 64 to either side of the platform 56 of the deployment apparatus 30. FIG. 13 is a view of an alternative embodiment of the inboard side 62 the cage 60 showing an alternative embodiment of the two sections 63, 64 separated from each other and defining the access opening 57 of the cage 60.

The lattice structure of the cage 160 schematically shown in FIGS. 5, 6 and 7 for example, similarly includes an inboard side 162 disposed spaced apart from the outboard side 161 of the cage 160 along the width of the cage 160. FIG. 7 shows a perspective view looking into the cage 160 from the outboard side 161 and back frame of the cage 160. As schematically shown in FIG. 7, the inboard side 162 of the cage 160 elongates along the length of the cage 160 between a front end 162*a* and a back end 162*b*. The inboard side 162 is configured for attachment to a deployment apparatus, such as the gangway apparatus 34 schematically shown in FIG. 7 for example. Thus, the inboard side 162 of the cage 160 desirably includes a front section 163 that is spaced apart from a back section 164 so that an access opening 57 is defined between the two sections 163, 164 to either side of the platform 156 of the deployment apparatus 34.

Figure 8:
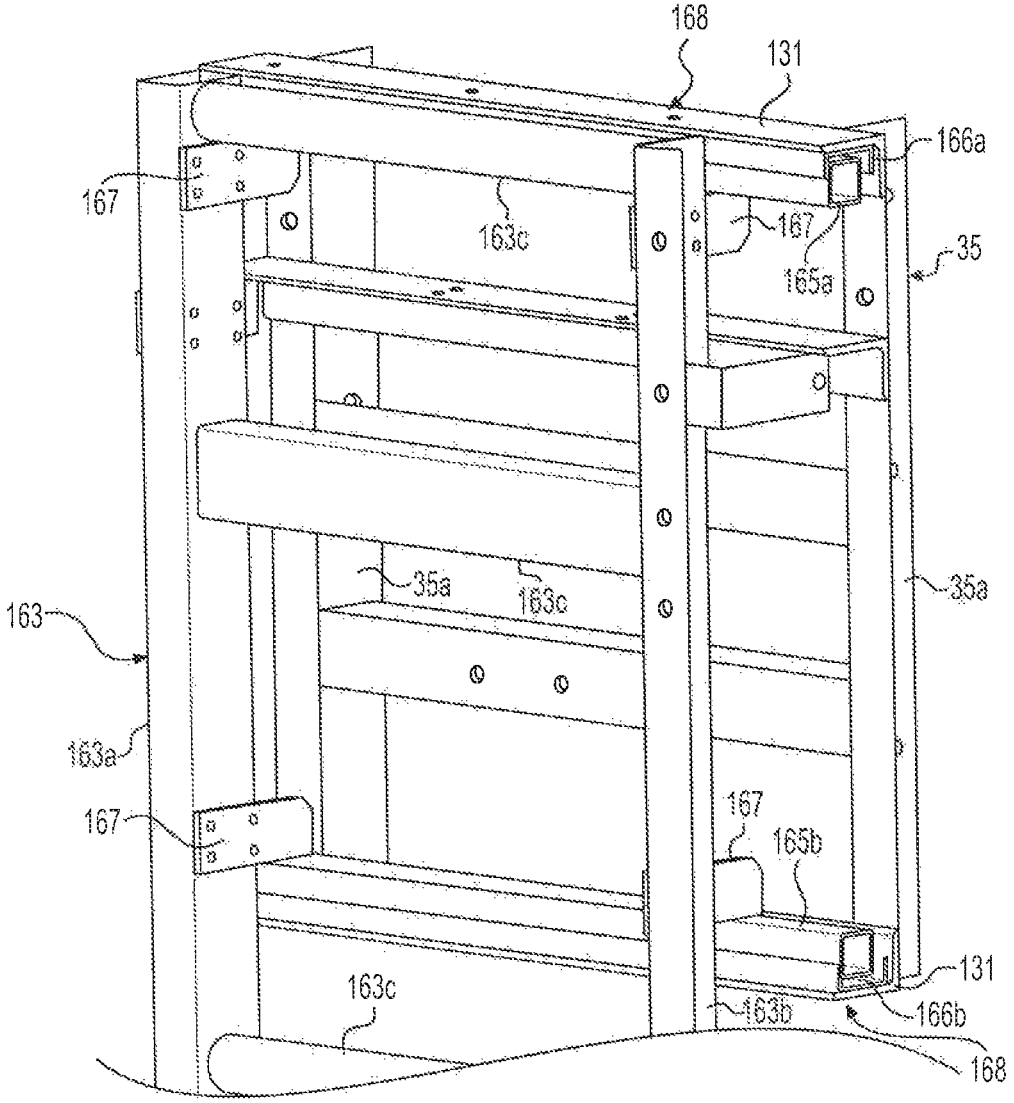
FIG. 8 is an elevated perspective view of embodiments of components of an embodiment of a cage shown in FIG. 7.

In accordance with one aspect of the present invention, each of the front section 163 and back section 164 includes a mechanism for slidable attachment to the deployment apparatus 34. Because each of the front section 163 and back section 164 of the inboard side 162 of the cage 160 is provided with a comparable mechanism for slidable attachment to the deployment apparatus 34, only the mechanism for the front section 163 will be described in detail for the sake of simplicity. As shown in FIG. 8, each of the two inboard sections 163, 164 is slidably connected to a fixed inboard rail section 35 that is rigidly connected to the outboard end of the gangway 34. Each fixed inboard rail section 35 is disposed to one of the opposite sides of the access opening 57 through which worker passage between the gangway 34 and the interior of the cage 160 can take place. The vertically extending interior extrusions 35*a* of the fixed inboard rail section 35 define the boundaries of the access opening 57 and desirably are formed of aluminum angle irons and measuring 1-½ inch per side. As shown in FIG. 8, the front section 163 includes an outward extrusion 163*a* and an inward extrusion 163*b* spaced apart from outward extrusion 163*a*. Each of the outward extrusion 163*a* and inward extrusion 163*b* extends vertically and parallel to the other. The outward extrusion 163*a* of the front section 163 desirably is formed of a hollow aluminum tube having a rectangular transverse shape and measuring 1 inch by 1-½ inch per side at the exterior. Each of a plurality of horizontally extending members 163*c* extending between and rigidly connecting the outward extrusion 163*a* and inward extrusion 163*b* of the front section 163 desirably is formed of a hollow aluminum tube, each having an exterior circular transverse shape and measuring 1 inch in diameter. However, as shown in FIG. 8, a horizontally extending member 163*c* formed of a hollow aluminum tube with a rectangular transverse shape can be employed, as can other transverse shapes.

Figure 9:
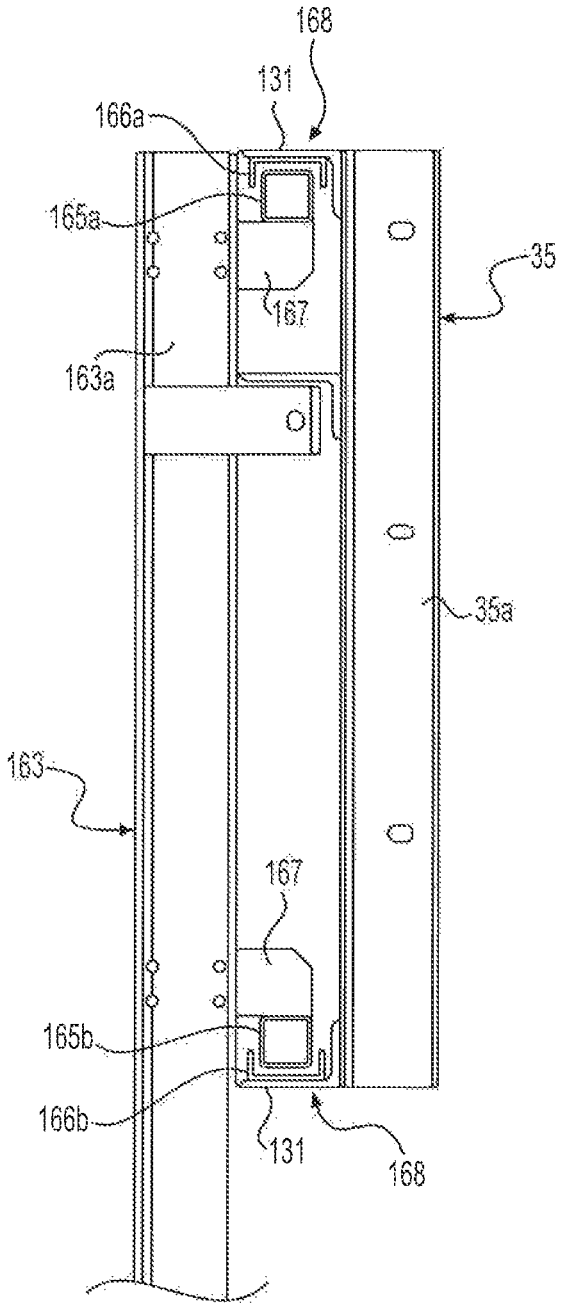
FIG. 9 is an end elevation view of components shown in FIG. 8.

FIG. 8 for example shows in a perspective view, the way that the front section 163 of the inboard side of cage 160 is slidably connected to a respective one of the fixed inboard rail sections 35. Because the same arrangement applies to the back section 164 of the inboard side of cage 160, for the sake of brevity the present description will only focus on the front section 163. FIG. 9 provides an end view of this arrangement. In the embodiment shown in FIGS. 8 and 9, the front section 163 is slidably connected to the fixed inboard section 35 by an upper tubular slide member 165*a* and a lower tubular slide member 165*b*. The upper tubular slide member 165*a* is slidably received within a respective upper track 166*a* carried in a supportive horizontal disposition by the fixed inboard section 35. Similarly, the lower tubular slide member 165*b* is slidably received within a respective lower track 166*b* carried in a supportive horizontal disposition by the fixed inboard section 35. Each of the front section 163 and the fixed inboard section 35 is disposed to lie in a respective parallel plane and spaced apart from each other sufficiently to accommodate this mechanism for sliding guiding the front section 163 with respect to the fixed inboard section 35. The upper slide member 165*a* desirably is welded to one end of each of a pair of flat flanges 167. The opposite end of each of flat flange is 167 desirably is mechanically fastened to a respective one of the outward extrusion 163*a* or vertically extending inward extrusion 163*b* of the movable front section 163 of the inboard side 162 of the cage 160. Similarly, the lower slide member 165*b* desirably is welded to one end of each of a pair of flat flanges 167. The opposite end of each of flat flange is 167 desirably is mechanically fastened to a respective one of the outward extrusion 163*a* or inward extrusion 163*b* of the movable front section 163 of the inboard side 162 of the cage 160. A plurality of threaded screws is suitable to effect both of these mechanical fastenings.

As shown in FIGS. 8 and 9, the upper track 166*a* desirably is welded to the interior surface of one leg of each of a pair of right angle flanges 168. The exterior surface 131 of one end of the opposite leg of each of the right angle flanges is 168 desirably is mechanically fastened as by welding to a respective one of the vertically extending outward extrusions 35*a* of the fixed inboard rail section 35, Similarly, the lower track 166*b* desirably is welded to the interior surface of one leg of the other one of the pair of right angle flanges 168. The exterior surface 131 of one end of the opposite leg of the other one of the pair of right angle flanges is 168 desirably is mechanically fastened as by welding to the other one of the outward vertically extending extrusions 35*a* of the fixed inboard rail section 35.

As schematically shown in FIG. 7, each pair consisting of a movable front section 163 and a fixed inboard rail section 35 is provided with a pneumatic cylinder 169 that can be operated via a pneumatic circuit (not shown) to move the cage 160 from side to side with respect to the access opening 57 at the distal end of the gangway 34. One end of each pneumatic cylinder 169 is attached to the movable front section 163 of the pair, and the opposite end of the pneumatic cylinder 169 is attached to the pair's fixed inboard rail section 35. By simultaneous operation of the pneumatic cylinders 169 attached respectively to the movable front section 163 and the movable back section 164 of the inboard side 162 of the cage 160, the operator can position the fence notches 171, 173 defined at each opposite end of the outboard side 161 of the cage 160 so as to accommodate the transversely extending end rails 46 (See FIG. 2) of the handrail 45 of the fence 43 on the top 41 of the tank 40. In this way, the operator can adjust for any slight misalignment between the railing structure atop the tank 40 and the platform from which the gangway 34 is deployed. Moreover, the embodiment of the cage 60 shown in FIG. 3 can be outfitted with a mechanism for slidable attachment to the deployment apparatus 30 substantially as described above.

As schematically shown in FIGS. 3 and 7 for example, the lattice structure of each respective embodiment of the cage 60, 160 desirably includes a respective front frame 80, 180 elongating along the width of the respective cage 60, 160 between a respective inboard end 80*a*, 180*a* and a respective outboard end 80*b*, 180*b*. The lattice structure includes a back frame 90, 190 that elongates along the width of the cage 60, 160 between an inboard end 90*a*, 190*a* of the back frame 90, 190 and an outboard end 90*b*, 190*b* of the back frame 90, 190. The back frame 90, 190 is essentially a mirror image of the front frame 80, 180, and accordingly the description of the front frames 80, 180 and the back frames 90, 190 are interchangeable. To take advantage of this coincidence for the sake of brevity, the perspective views shown in FIGS. 3 and 7 will dictate whether the description that follows will reference the particular features of the front frames 80, 180 or the back frames 90, 190.

As shown in FIG. 7, the inboard end 180*a* of the front frame 180 is connected to the inboard side 162 of the cage 160, and the outboard end 180*b* of the front frame 180 is connected to the outboard side 161 of the cage 160. As shown in FIG. 7, the inboard end 190*a* of the back frame 190 defines an inboard gap 191 with a blind end 191*a* near the top edge of the cage 160 and an open end at the bottom edge of the cage 160. The back frame 190 further defines a central recess 192 disposed between the inboard end 190*a* of the back frame 190 and the inboard gap 191 at the inboard end 190*a* of the back frame 190. The central recess 192 of the back frame 190 defines an open end at the bottom edge of the cage 160. The central recess 192 of the back frame 190 defines a blind end 192*a* that is disposed generally intermediate the top edge of the cage 160 and the bottom edge of the cage 160.

Figure 10:
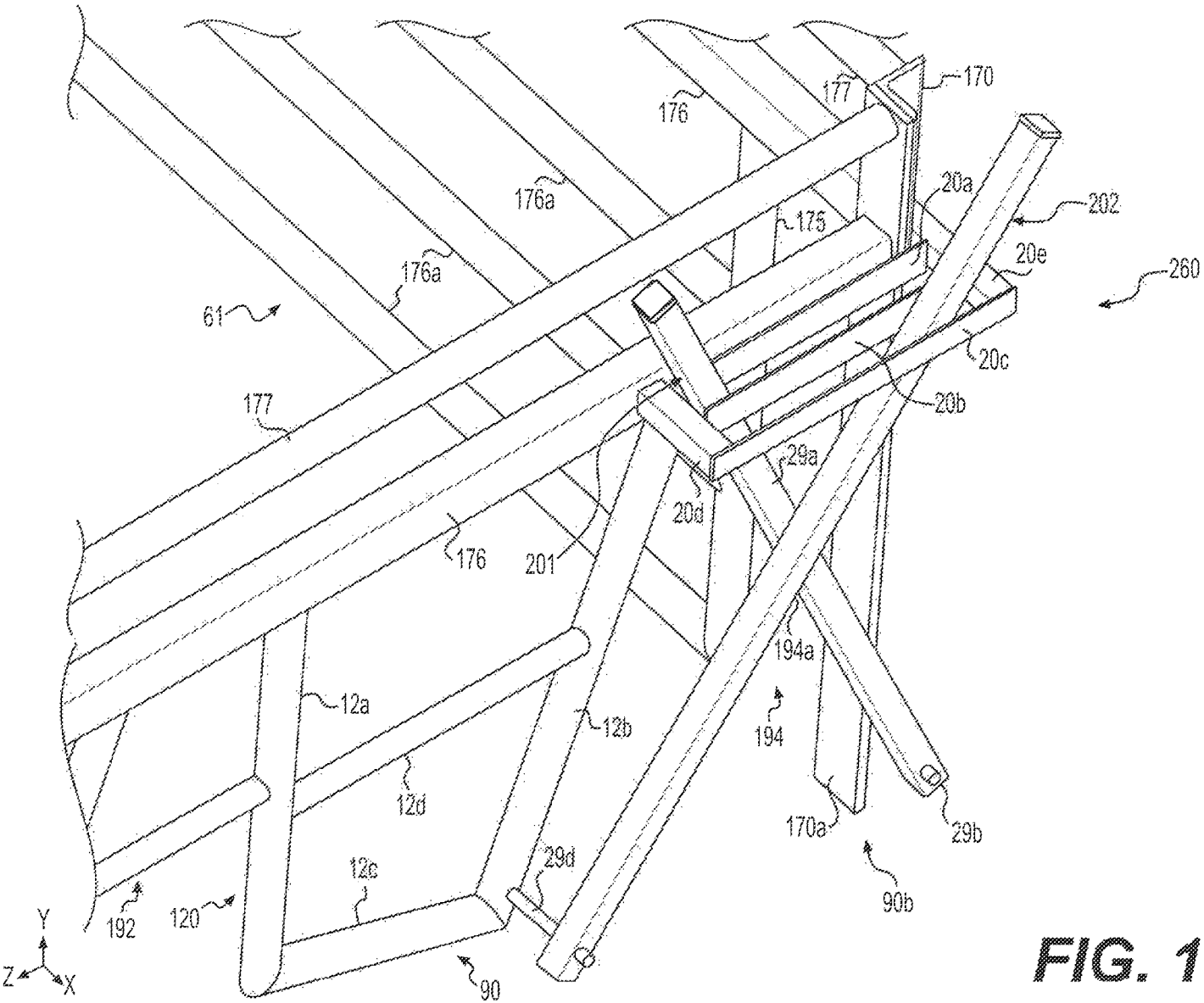
FIG. 10 is an elevated perspective view of a corner of an alternative embodiment of a cage similar to the embodiments shown in FIGS. 1 and 3 and where the back frame of the cage meets the outboard side of the cage.

As shown in FIG. 3 for example, the back frame 90 of the cage 60 includes a pair of central guard webs 120, one of the central guard webs 120 being disposed closer to the respective inboard end 90*a* of the back frame 90, the other one of the central guard webs 120 being disposed closer to the outboard end 90*b* of the back frame 90. A corner of an alternative embodiment of a cage 260 similar in many ways to the embodiment depicted in FIGS. 1, 3 and 4 is schematically shown in FIG. 10. The enlarged perspective view of FIG. 10 schematically depicts the intersection of the outboard side 61 and the back frame 90 of cage 260 and will be described in more detail as follows.

As shown in FIG. 10, the uppermost ends of each of the central guard webs 120 desirably are welded to the underside of a major horizontal support 176 of the back frame of the cage 260. The major horizontal support 176 elongates in the longitudinal direction and desirably is formed of 0.125 inch thickness aluminum tubing having a rectangular cross-section measuring 2" wide by 3" tall. As shown in FIG. 10, the central guard web 120 disposed toward the outboard end 90*b* of the back frame 90 includes a straight leg 12*a* that vertically depends from the major horizontal support 176. The central guard web 120 disposed toward the outboard end 90*b* of the back frame 90 also includes an angled leg 12*b* that depends from the major horizontal support 176 and tilts at less than a right angle toward the straight leg 12*a* of this central web 120 disposed toward the outboard end 90*b* of the back frame 90. Thus, the angled leg 12*b* is disposed between the straight leg 12*a* and the corner pillar 170 of the back frame 90. These two legs 12*a*, 12*b* desirably are connected to one another by a bottom bridge 12*c* that connects the ends of these two legs 12*a*, 12*b* that are opposite the ends of the legs 12*a*, 12*b* that are connected to the major horizontal support 176. Additionally, these two legs 12*a*, 12*b* are connected at the opposite ends of a middle bar 12*d* that is disposed about midway between the major horizontal support 176 and the bottom bridge 12*c* and elongates in the transverse direction and substantially parallel to the elongation direction of the major horizontal support 176. The bottom bridge 12*c* desirably elongates at an angle to the elongation direction of the major horizontal support 176 and at an angle that is greater than a right angle by the degree of deviation with respect to the elongation direction of the major horizontal support 176.

As shown in FIG. 10, the outboard end 90*b* of the back frame 90 defines an outboard gap 194 with a blind end 194*a* near the top edge of the cage 260 and an open end at the bottom edge of the cage 260. The depth of the gap 194 is the distance between the open end of the gap 194 at the bottom edge of the cage 60, 260 and the blind end 194*a*. For example, the outboard gap 194 is defined between the angled leg 12*b* of the central guard web 120 that is disposed toward the outboard end 90*b* of the back frame 90 and the corner pillar 170 of the outboard end 90*b* of the back frame 90 that is disposed closer to the outboard side 61 of the cage 260. The outboard gap 194 of the back frame 90 is desirably configured so that the cage 260 is assured of being positioned clear of any longitudinally extending side rails 47 (See FIG. 2 for example) of the fence 43 on the railcar that could potentially be located where the cage 260 drops down. The back frame 90 of the cage 260 defines a central recess 192 disposed between the outboard end 90*b* of the back frame 90 and the outboard gap 194 at the outboard end 90*b* of the back frame 90. The central recess 192 defines an open end at the bottom edge of the cage 260 and a blind end that is disposed generally intermediate the top edge of the cage 260 and the bottom edge of the cage 260.

In accordance with another aspect of the present invention, the outboard gap 194 in the back frame 90 is provided with its own self-adjusting straddle that is configured to encounter the side rails 47 (FIG. 2) that extend longitudinally along the outboard side of the fence 43 atop the tank 40 where the cage 260 is to be deployed. The front frame similarly is provided with its own self-adjusting straddle in a mirror image of the self-adjusting straddle of the back frame 90. This self-adjusting straddle feature of the outboard gaps in the front frame 80 and the back frame 90 of the cage 260 ensures that the side rails 47 (FIG. 2) of the fence 43 at the top 41 of the tank 40 are received within the respective self-adjusting gap 194 that is formed at each respective front frame 80 and the back frame 90 at the outboard side 61 of the cage 260. The self-adjusting gap 194 of this self-adjusting straddle feature is self-adjusting both as to the depth of the gap and as to the location within the gap where the cage 60, 260 will encounter the side rails 47 of the handrail 45 of the fence 43 at the top 41 of the tank 40. The self-adjusting straddle aspect is perhaps best explained with reference to FIG. 10, which illustrates in a perspective view the corner of a cage 260 where the outboard side 61 meets the back frame 90.

As shown in FIG. 10, the straddle desirably includes a dual track raceway 20. The outboard end of the raceway 20 is connected to the opposite side of the corner pillar 170 of the outboard side 61 of the cage 260 to which the major horizontal support 176 of the outboard side 61 of the cage 260 is connected. The inboard end of the raceway 20 is connected to the 176 of the back frame 90 of the cage 260. The dual track raceway 20 desirably includes three slats 20*a*, 20*b*, 20*c* extending parallel to each other and spaced apart from each other to define the dual tracks for the self-adjusting straddle. As shown in FIG. 10, a central slat 20*b* is disposed between a pair of side slats 20*a*, 20*c*. The opposite ends of three slats 20*a*, 20*b*, 20*c* are connected to a respective one of the inboard end 20*d* of the raceway 20 and outboard end 20*e* of the raceway 20. The central slat 20*b* is desirably spaced equidistantly between the two side slats 20*a*, 20*c* so as to define a pair of side-by-side tracks. As shown in FIG. 10, a proximal one of the two tracks so defined is disposed closer to the major horizontal support 176 than to the distal one of these two tracks.

As shown in FIG. 10, the self-adjusting straddle desirably includes a pair of pivot bars 201, 202, which in the embodiment shown in FIG. 10 are configured as straight bars along their entire lengths without any angled or curved sections. The lower end of a proximal pivot bar 201 is pivotally connected to the corner pillar 170 of the outboard side 61 of the cage 260. One end of a proximal axle 29*b* is fixed in the vicinity of the distal end 170*a* of the corner pillar 170 and extends longitudinally therefrom, and the opposite end of the proximal axle 29*b* is carried in a bearing (not shown) that is rotatably carried by the lower end of the proximal pivot bar 201. The upper end of the proximal pivot bar 201 extends through the proximal track and is constrained to pivot within the proximal track. The lower end of a distal pivot bar 202 is pivotally connected to the lower end of the angled leg 12*b* of the central guard web 120 that is disposed toward the outboard end of the back frame 90 of the cage 260. One end of a distal axle 29*d* is fixed to the lower end of the angled leg 12*b* of the central guard web 120 that is disposed toward the outboard end 90*b* of the back frame 90 of the cage 260, and the opposite end of the distal axle 29*d* is carried in a bearing that is rotatably carried by the lower end of the distal pivot bar 202. The upper end of the distal pivot bar 202 extends through the distal track and is constrained to pivot within the distal track. Thus, the self-adjusting straddle desirably is configured so that each of the straddling pivot bars 201, 202 can undergo pivotal movement independent of the other.

As the cage 260 is lowered toward the top 41 of the tank 40, each pair of pivot bars 201, 202 will encounter the longitudinally extending handrail 47 of the fence 43 atop the tank 40. As the cage 260 continues to be lowered, the pivot bars 201, 202 will slide on the handrail 47 by virtue of the ability of the pivot bars 201, 202 to rotate within each respective track of the raceway 20. In so doing, the pivoting pivot bars 201, 202 self-adjust to reduce size of the outboard gaps 194 permitted in the configurations of the front frame 80 and back frame 90 of the cage 260. Where the two pivot bars 201, 202 intersect will define the blind end 194*a* of the outboard gap 194 in each respective front frame 80 and back frame 90 of the cage to 60. Accordingly, the depth of the blind end 194*a* of the outboard gap 194 is self-adjusting so as to be automatically adaptable to the height configuration of the fence 43. Similarly, where the two pivot bars 201, 202 intersect will determine whether the blind end 194*a* of the outboard gap 194 will be disposed closer to the outboard side 61 of the cage 260 or closer to the inboard side 62 of the cage 260. Thus, the blind end 194*a* of the outboard gap is adaptable to the location of the handrail 47 of fences 43 having differing width dimensions. Moreover, each set of pivoting bars 201, 202 acts independently of the other set of pivoting bars 201, 202, and thus the two sets in effect work together so as to compensate for any less than rectilinear lowering of the cage 260 with respect to the fence 43 configuration at the top 41 of the tank 40.

Figure 11:
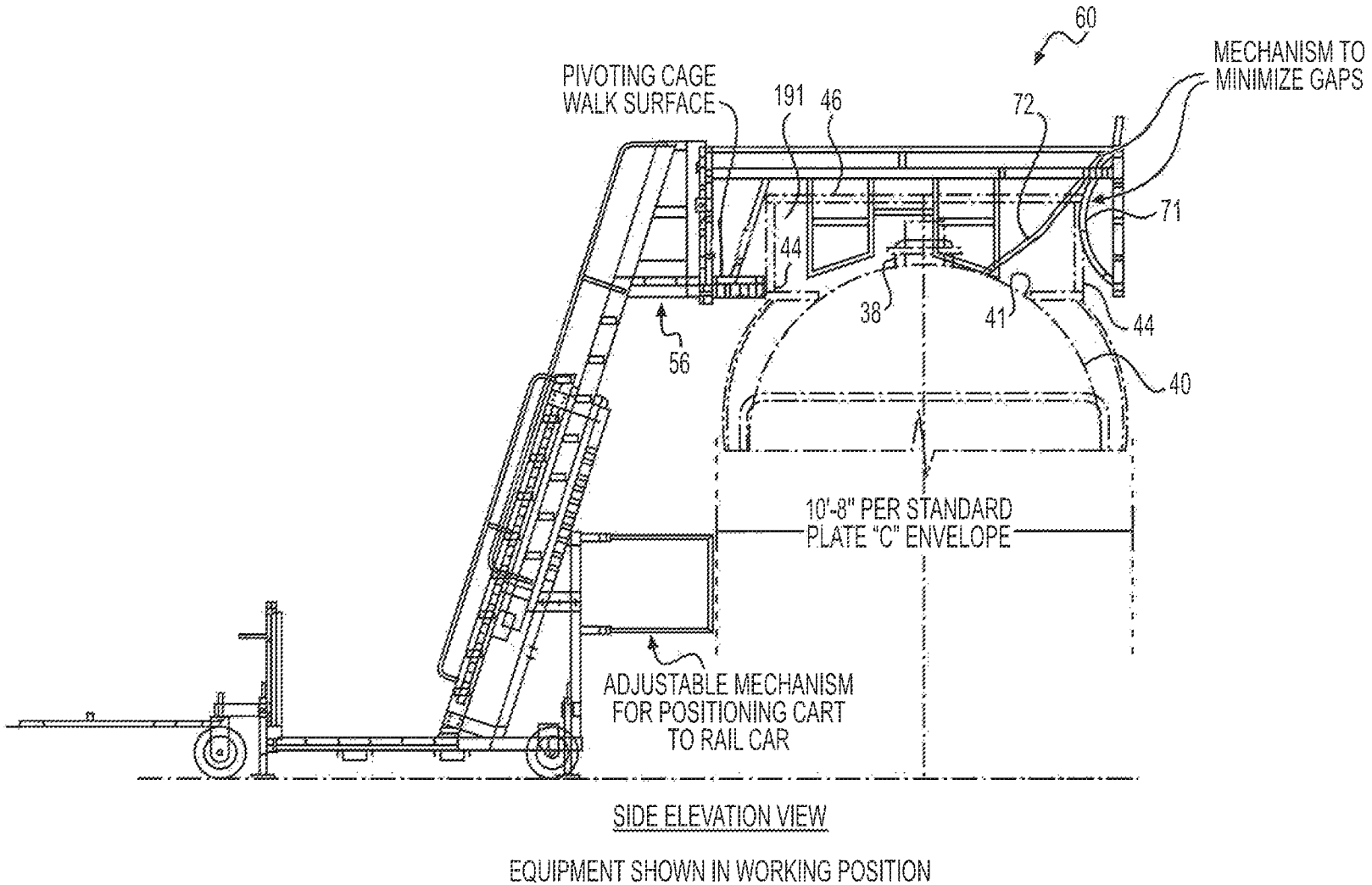
FIG. 11 is an end elevation view an embodiment of the present invention disposed in an orientation that is being lowered toward the top of a tank shown in partial outline wider than the tank depicted in FIG. 1.

FIGS. 1 and 11 are provided to explain a presently preferred embodiment of the pivot bars of the self-adjusting straddle feature of the present invention described above in connection with FIG. 10. As shown in FIGS. 1 and 11, the self-adjusting straddle desirably includes a pair of pivot bars 71, 72. Each of the proximal pivot bar 71 and the distal pivot bar 72 is connected to the cage 60 in the same manner as already described above for the straight pivot bars 201, 202. However, the configuration of the pivot bars 71, 72 shown in FIGS. 1, 3, 11 and 12 differs from the configuration of the straight pivot bars 201, 202 shown in FIG. 10. The configuration of the proximal pivot bar 71 shown in a perspective view in FIG. 12 for example is largely composed of an arcuate section 71*a* that has a radius of curvature that desirably falls within the range of 3 feet to 4 feet. One end of a straight section 71*b* of the proximal pivot bar 71 is connected to one end of the arcuate section 71*a*, while the opposite end of the arcuate section 71*a* desirably is the end of the arcuate section 71*a* that is pivotally connected to the outboard side 61 of the cage 60 in the same manner as described above in connection with the embodiment depicted in FIG. 10. Thus, one end of a proximal axle 29*b* is fixed to the corner pillar 170 and extends longitudinally therefrom, and the opposite end of the proximal axle 29*b* is carried in a bearing (not shown) that is rotatably carried by the lower end of the arcuate section 71*a* of the proximal pivot bar 71.

As shown in a perspective view in FIG. 3 for example, the configuration of the distal pivot bar 72 is defined by two straight sections 72*a*, 72*b* connected to one another by a knee bend such that an obtuse angle is defined between the two straight sections 72*a*, 72*b*. The obtuse angle desirably falls within the range of between 165 and 175°. The lengths of each of the two straight sections desirably are approximately equal to one another. Thus, the lower end of a distal pivot bar 72 (shown in FIGS. 1, 3, 4 and 11) is pivotally connected to the lower end of the angled leg 12*b* of the central guard web 120 that is shown in FIG. 10 and disposed toward the outboard end of the back frame 90 of the cage 60. One end of a distal axle 29*d* is fixed to the lower end of the angled leg 12*b* of the central guard web 120 that is disposed toward the outboard end 90*b* of the back frame 90 of the cage 60, and the opposite end of the distal axle 29*d* is carried in a bearing that is rotatably carried by the lower end of one straight section 72*b* of the distal pivot bar 72. The upper end of the distal pivot bar 72 (shown in FIGS. 1, 3, 4 and 11) extends through the distal track and is constrained to pivot within the distal track. Thus, the self-adjusting straddle desirably is configured so that each of the straddling pivot bars 71, 72 can undergo pivotal movement independent of the other.

As the cage 60 is lowered toward the top 41 of the tank 40, the blind end 194*a* of the outboard gap 194 formed by the crossing intersection of each pair of pivot bars 71, 72 will encounter the longitudinally extending handrail 47 of the fence 43 atop the tank 40. As the cage 60 continues to be lowered, the pivot bars 71, 72 will slide on the handrail 47 by virtue of the ability of the pivot bars 71, 72 to rotate within each respective track of the raceway 20. In so doing, the pivoting pivot bars 71, 72 self-adjust to reduce the size of the outboard gaps that are permitted in the configurations of the front frame 80 and back frame 90 of the cage 60. Moreover, each set of pivoting bars 71, 72 acts independently of the other set of pivoting bars 71, 72 and thus the two sets in effect work together so as to compensate for any less than rectilinear lowering of the cage 60 with respect to the fence configuration at the top 41 of the tank 40.

FIGS. 1 and 11 illustrate the same cage 60 being lowered onto a tank car having the Standard Plate C Envelope but with different railing configurations. In FIG. 1, the upper ends of the side rails 39 of the ladder terminate at the foot of a railing system of six-foot width. While in FIG. 11, the width of the railing system is 8 feet. Comparing FIG. 1 to FIG. 11, one can appreciate how the pivoting bars 71, 72 of the straddle at the outboard end of the cage 60 self-adjust to accommodate the different widths of the respective railing systems. As shown in FIG. 1, the inboard gap 191 straddles the vertical post 44 of the fence 43 with the vertical leg disposed closer to the vertical post 44 than is the case in the situation depicted in FIG. 11 where the angled leg defining the inboard gap 191 is disposed closer to the vertical post 44. In both cases, the pivot bars 71, 72 defining the outboard gap 194 engage the fence 43, but at different locations due to the differing widths of the fence in FIG. 1 versus the fence in FIG. 11.

Figure 12:
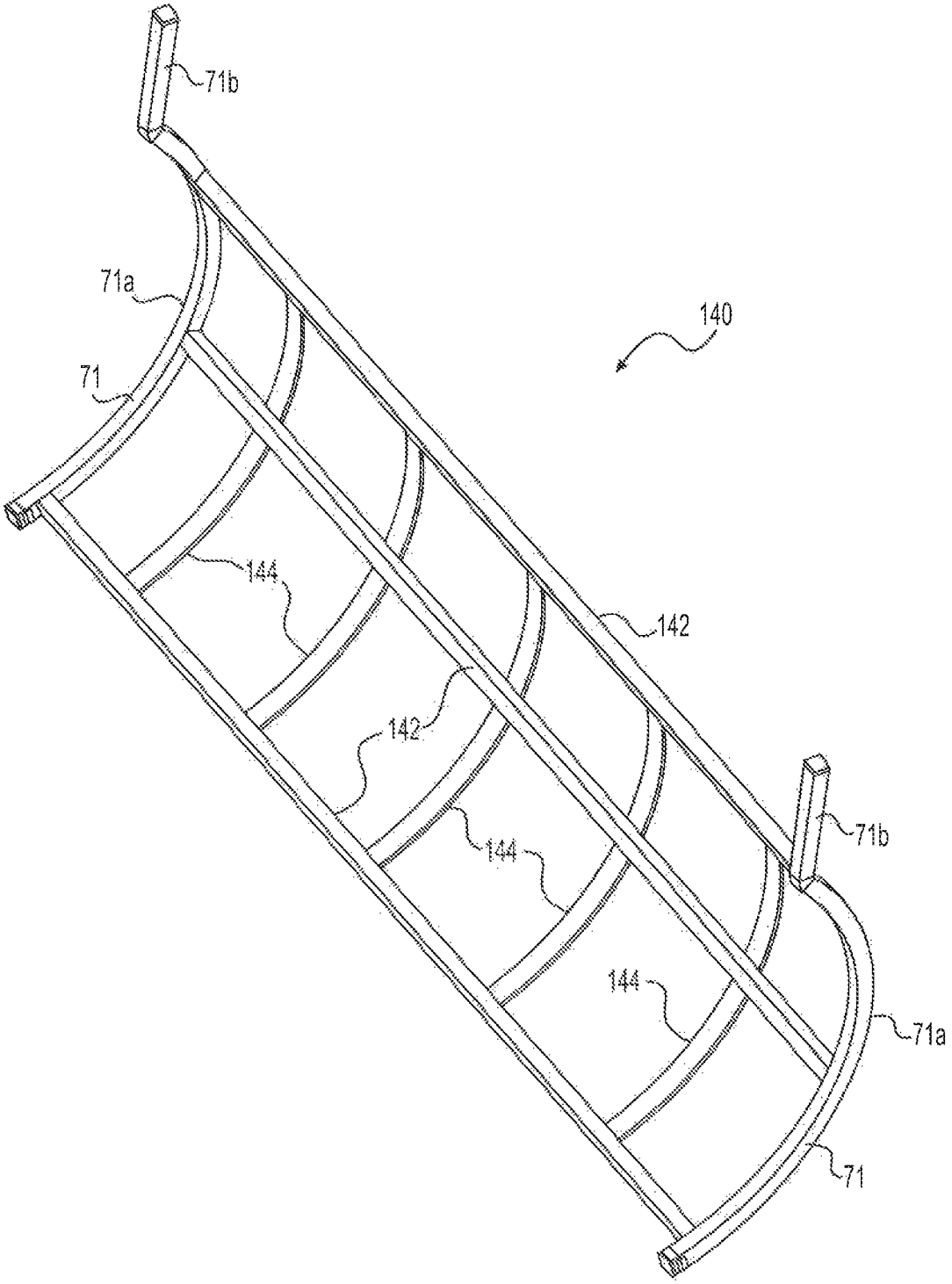
FIG. 12 is a perspective view of components shown in FIGS. 1, 3 and 4.

As shown in FIG. 12, an arcuate grill 140 is carried between and by the arcuate sections 71*a* of the proximal pivot bars 71 at the opposite ends of the cage 60. The exemplary embodiment of the grill 140 shown in perspective view in FIG. 12 for example is defined by at least 3 straight rods 142 spaced apart from one another and extending parallel to one another. As shown in FIG. 12, each opposite end of each straight rod 142 is connected to one of the arcuate sections 71*a* of the proximal pivot bar 71 on either end of the cage 60. As shown in FIG. 12, the arcuate grill 140 is further defined by a plurality of arcuately shaped ribs 144 that are disposed perpendicular to the straight rods 142 and connected to the straight rods 142. The arcuately shaped ribs 144 desirably are disposed parallel to one another. The arcuate grill 140 carried by the arcuate sections 71*a* of the two proximal pivot bars 71 ensures blockage of any openings in the railing system at the top 41 of the tank 40 on the outboard side of the tank 40 and thus functions like a rigid net that prevents workers from slipping through gaps in the railing system at the top 41 of the tank 40.

Though the embodiment of the straddling mechanism described above has been configured as part of the outboard side 61 of the cage 60, 260, the same sort of straddling mechanism can be configured as part of the inboard side 62 of the cage 60, 260.

In accordance with one aspect of the present invention schematically shown in FIG. 1 for example, the portable deployment apparatus 30 desirably can include an adjustable positioning mechanism 150 that ensures that the portable deployment apparatus 30 is spaced from the railcar by a distance that ensures precisely lowering of the cage 60 with respect to a fence 43 at the top 41 of the tank 40. Thus, the positioning mechanism 150 is provided to enable a reliably correct positioning of the cage 60, 160 so that when the cage 60, 160 is lowered onto the top 41 of the tank 40, each of the notches in the cage 60, 160 avoids undesired interference with the fence 43 and any valve structure 38 on the top 41 of the tank 40. As embodied herein and shown in FIG. 1 for example, a positioning mechanism 150 is mounted to a stanchion 58 that has a lower end firmly attached to the forward end of the base 53 connected to the chassis 50 of the portable vehicle by which the cage 60, 160 can be moved into position adjacent the rolling stock located on a side track. The positioning mechanism 150 desirably includes a pair of hollow sleeves 151, 152. One end of a top sleeve 151 is permanently attached as by welding to the uppermost end of the stanchion 58 so as to extend horizontally therefrom. Similarly, one end of a bottom sleeve 152 is permanently attached to the stanchion 58 as by welding at a location that is disposed beneath the top sleeve 151. Desirably, the vertical spacing between the two sleeves 151, 152 is on the order of 3 feet. Each of the sleeves 151, 152 desirably is formed by an aluminum tube having a square transverse shape and measuring 2 inches per side, 0.125 inches thick and extending outwardly from the stanchion 58 by about 27 inches.

As shown in FIG. 1 for example, the positioning mechanism 150 also includes a telescoping member 153 having a pair of opposed ends, each of which being configured to be slidably received within a respective open end of either the top sleeve 151 or the bottom sleeve 152. The telescoping member 153 desirably takes the shape of three sides of a rectangle that includes a bottom leg, 154, top leg 155 and a vertical leg 156 extending between and connecting the bottom leg 154 to the top leg 155. The missing fourth side of the otherwise rectangular embodiment of the telescoping member 153 leaves the top leg 155 defining a free end that is configured to be received in the top sleeve 151 and similarly the bottom leg 154 defining a free and that is configured to be used received in the bottom sleeve 152. Thus, the free ends of the respective top leg 155 and bottom leg 154 are slidably received in the respective top sleeve 151 and bottom sleeve 152 in a telescoping fashion. As shown in FIG. 1 for example, each of the legs 154, 155 extends outwardly from the vertical leg 156, which connects the legs 154, 155, by a distance of about 3 feet. The telescoping member 153 desirably is formed of aluminum tubes 0.125 inches thick and having a square transverse shape measuring 1-½ inch per side.

Moreover, the positioning mechanism 150 desirably includes an adjustment feature by which the distance between the vertical leg 156 and the stanchion 58 can be varied selectively by the user. A series of holes (not shown) is provided along the length of the top sleeve 151 and aligned in a straight line therealong. These holes are spaced apart from each adjacent hole by about 1 inch. A matching series of holes (not shown) is provided in the free end of the top leg 155 of the telescoping member 153. Alignment of one of the holes in the top leg 155 of the telescoping member with one of the holes in the top sleeve 151 affords the opportunity to insert a pin (not shown) through both aligned holes so as to fix the position of the top leg 155 with respect to the top sleeve 151. A similar series of holes (not shown) desirably is provided in the bottom sleeve 152, and a similar series of holes (not shown) desirably is provided in the free end of the bottom leg 154 of the telescoping member 153. By operation of this adjustment feature, the position of the vehicle carrying the cage 60, 160 relative to the rolling stock onto which the cage 60, 160 is to be lowered is determined by when the vertical leg 156 reaches the inboard side 31 of the Standard Plate C Envelope as shown in FIG. 1 for example. The user, having knowledge of the particular rolling stock involved, can adjust the distance of the vertical leg 156 from the stanchion 58 and in so doing determine the precise (to the degree of the spacing between the holes) positioning of the cage 60, 160 as the platform 56 is disposed at the appropriate height at the upper end of the extension ladder 55.

While at least one presently preferred embodiment of the invention has been described using specific terms, such description is for illustrative purposes only, and it is to be understood that changes and variations may be made without departing from the spirit or scope of the following claims. This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A fall protection cage that can be extended to the top of rolling stock from a deployment apparatus and configured for surrounding a section of a work area disposed at the top of the rolling stock and provided with a fence including a handrail disposed above and surrounding the work area, the fall protection cage comprising:

a lattice structure defining a generally quadrilateral shape with a top edge, a bottom edge, a depth extending in a direction between the top and bottom edges, the lattice having a length measured in a longitudinal direction and a width measured in a transverse direction that is perpendicular to the longitudinal direction and perpendicular to the direction in which the depth is extending;

the lattice structure including an outboard side elongating along the length of the cage between a front end of the outboard side and a back end of the outboard side, the front end of the outboard side defining a front fence notch with a blind end near the top edge of the cage and an open end at the bottom edge of the cage, the back end of the outboard side defining a back fence notch with a blind end near the top edge of the cage and an open end at the bottom edge of the cage;

the lattice structure including an inboard side elongating along the length of the cage between a front end and a back end, the inboard side disposed spaced apart from the outboard side along the width of the cage, the inboard side configured for attachment to the deployment apparatus;

the lattice structure including a front frame elongating along the width of the cage between an inboard end and an outboard end, the inboard end of the front frame connected to the inboard side, the outboard end of the front frame connected to the outboard side, the outboard end of the front frame defining an outboard gap with a blind end near the top edge of the cage and an open end at the bottom edge of the cage, the front frame defining a central recess disposed between the inboard end of the front frame and the outboard gap at the outboard end of the front frame, the central recess defining an open end at the bottom edge of the cage, the central recess defining a blind end that is disposed generally intermediate the top edge of the cage and the bottom edge of the cage; and the lattice structure including a back frame elongating along the width of the cage between an inboard end of the back frame and an outboard end of the back frame, the inboard end of the back frame connected to the inboard side, the outboard end of the back frame connected to the outboard side, the outboard end of the back frame defining an outboard gap with a blind end near the top edge of the cage and an open end at the bottom edge of the cage, the back frame defining a central recess disposed between the inboard end of the back frame and the outboard gap at the outboard end of the back frame, the central recess defining an open end at the bottom edge of the cage, the central recess defining a blind end that is disposed generally intermediate the top edge of the cage and the bottom edge of the cage;

wherein the outboard gap of the front frame is defined by a pair of pivot bars, each of the pivot bars having a bottom end pivotally connected near the open end of the outboard gap at the bottom edge of the cage.

2. The fall protection cage of claim 1, wherein each of the pivot bars is disposed non-parallel to the other pivot bar.

3. The fall protection cage of claim 1, wherein one of the pivot bars being defined by a pair of straight legs connected at an obtuse angle to each other.

4. The fall protection cage of claim 1, wherein one of the pivot bars being defined by a straight leg connected to an arcuately shaped leg.

5. The fall protection cage of claim 4, wherein the bottom end of the arcuately shaped leg is pivotally connected near the open end of the outboard gap of the front frame at the bottom edge of the cage.

6. The fall protection cage of claim 1, wherein the front end of the inboard side defines a front fence notch with a blind end near the top edge of the cage and an open end at the bottom edge of the cage, wherein the back end of the inboard side defines a back fence notch with a blind end near the top edge of the cage and an open end at the bottom edge of the cage.

7. A fall protection cage, comprising:

a wheeled support vehicle having a chassis;

a manually operated extension ladder having a base section carried by the chassis and a fly section extendably connected to the base section;

a support member carried by the chassis and having a foot at one end of the support member connected to the chassis, the support member being connected to the extension ladder so as to support the extension ladder in a disposition forming the hypotenuse of a right triangle with the support member and the chassis;

a platform that extends horizontally outwardly from the fly section:

a cage configured for surrounding a section of a work area disposed at the top of rolling stock, the cage defining a generally quadrilateral shape with a top edge, a bottom edge, a depth extending between the top and bottom edges, the cage having a length measured in a longitudinal direction and a width measured in a transverse direction that is perpendicular to the longitudinal direction the cage being connected to the platform: and a positioning mechanism including a top hollow sleeve, a bottom hollow sleeve disposed vertically spaced apart from the top hollow sleeve, a telescoping member having a bottom leg and a top leg connected via a vertical leg, one end of the top hollow sleeve being connected to the support member, one end of the bottom hollow sleeve being connected to the support member, one end of the top leg of the telescoping member being slidably disposed within the top hollow sleeve, one end of the bottom leg of the telescoping member being slidably disposed within the bottom hollow sleeve.

8. The portable fall protection cage as in claim 7, further comprising:

a lattice structure defining a generally quadrilateral shape with a top edge, a bottom edge, a depth extending in a direction between the top and bottom edges, the lattice having a length measured in a longitudinal direction and a width measured in a transverse direction that is perpendicular to the longitudinal direction and perpendicular to the direction in which the depth is extending;

the lattice structure including an outboard side elongating along the length of the cage between a front end of the outboard side and a back end of the outboard side, the front end of the outboard side defining a front fence notch with a blind end near the top edge of the cage and an open end at the bottom edge of the cage, the back end of the outboard side defining a back fence notch with a blind end near the top edge of the cage and an open end at the bottom edge of the cage;

the lattice structure including an inboard side elongating along the length of the cage between a front end and a back end, the inboard side disposed spaced apart from the outboard side along the width of the cage, the inboard side configured for attachment to the deployment apparatus;

the lattice structure including a front frame elongating along the width of the cage between an inboard end and an outboard end, the inboard end of the front frame connected to the inboard side, the outboard end of the front frame connected to the outboard side, the outboard end of the front frame defining an outboard gap with a blind end near the top edge of the cage and an open end at the bottom edge of the cage; the front frame defining a central recess disposed between the inboard end of the front frame and the outboard gap at the outboard end of the front frame, the central recess defining an open end at the bottom edge of the cage, the central recess defining a blind end that is disposed generally intermediate the top edge of the cage and the bottom edge of the cage; and the lattice structure including a back frame elongating along the width of the cage between an inboard end of the back frame and an outboard end of the back frame, the inboard end of the back frame connected to the inboard side, the outboard end of the back frame connected to the outboard side, the outboard end of the back frame defining an outboard gap with a blind end near the top edge of the cage and an open end at the bottom edge of the cage, the back frame defining a central recess disposed between the inboard end of the back frame and the outboard gap at the outboard end of the back frame, the central recess defining an open end at the bottom edge of the cage, the central recess defining a blind end that is disposed generally intermediate the top edge of the cage and the bottom edge of the cage.

9. The fall protection cage of claim 8, further comprising:

a dual track raceway disposed at the top edge of the cage at the outboard end of the front frame, the dual track raceway defining an inner track disposed adjacent an outer track; and a pair of pivot bars, one of the pivot bars being confined to move within the inner track, and the other pivot bar being confined to move within the outer track.

10. The fall protection cage of claim 9, wherein one of the pivot bars being defined by a straight leg connected to an arcuately shaped leg.

* * * * *